US008020602B2

(12) United States Patent
Smith et al.

(10) Patent No.: US 8,020,602 B2
(45) **Date of Patent: *Sep. 20, 2011**

(54) SYSTEM FOR OPERATING TOP DOWN/BOTTOM UP COVERING FOR ARCHITECTURAL OPENINGS

(75) Inventors: Stephen P. Smith, Denver, CO (US); Kent A. Smith, Broomfield, CO (US); James L. Miller, Henderson, CO (US); Terrence M. Drew, Superior, CO (US); Suzanne M. Fujita, Louisville, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 116 days.

This patent is subject to a terminal disclaimer.

(21) Appl. No.: 12/496,934

(22) Filed: Jul. 2, 2009

(65) Prior Publication Data

US 2009/0263637 A1 Oct. 22, 2009

Related U.S. Application Data

(62) Division of application No. 11/957,158, filed on Dec. 14, 2007, now Pat. No. 7,571,756.

(60) Provisional application No. 60/871,015, filed on Dec. 20, 2006.

(51) Int. Cl.
*E06B 9/08* (2006.01)

(52) U.S. Cl. ..... 160/121.1; 160/87

(58) Field of Classification Search ..... 160/87, 160/169, 167 R, 120, 320, 321, 121.1
See application file for complete search history.

(56) References Cited

U.S. PATENT DOCUMENTS

| | | | | |
|---|---|---|---|---|
| 4,372,432 | A | 2/1983 | Waine et al. | |
| 4,813,468 | A | 3/1989 | Fraser | |
| 5,419,385 | A * | 5/1995 | Vogel et al. | 160/121.1 |
| 5,503,210 | A * | 4/1996 | Colson et al. | 160/84.05 |
| 5,562,797 | A * | 10/1996 | Phelps | 156/510 |
| 5,791,390 | A | 8/1998 | Watanabe | |
| 6,001,199 | A * | 12/1999 | Colson et al. | 156/65 |
| 6,112,797 | A * | 9/2000 | Colson et al. | 160/121.1 |
| 6,289,964 | B1 | 9/2001 | Colson et al. | |
| 6,435,252 | B2 | 8/2002 | Colson et al. | |
| 6,530,413 | B2 | 3/2003 | Hwang | |
| 6,688,369 | B2 * | 2/2004 | Colson et al. | 160/121.1 |
| 6,834,701 | B2 | 12/2004 | Colson et al. | |
| 6,904,948 | B2 * | 6/2005 | Auger et al. | 160/121.1 |
| 7,059,378 | B2 * | 6/2006 | Colson et al. | 160/121.1 |
| 7,063,122 | B2 | 6/2006 | Colson et al. | |
| 7,111,659 | B2 * | 9/2006 | Harper et al. | 160/84.05 |

(Continued)

FOREIGN PATENT DOCUMENTS

EP 1 455 048 A1 9/2004

(Continued)

*Primary Examiner* — Blair M Johnson
*Assistant Examiner* — Jaime F Cardenas-Garcia
(74) *Attorney, Agent, or Firm* — Dorsey & Whitney LLP

(57) ABSTRACT

A control system for a top down/bottom up covering for an architectural opening includes a common drive shaft for raising and lowering a middle rail and a bottom rail between which a flexible shade material extends. A control element operates a spool lift system and a roller lift system, with the spool lift system being associated with the middle rail and the roller lift system being associated with the bottom rail. The lift systems are sequentially operated when the drive shaft is driven in either direction by the control element.

5 Claims, 44 Drawing Sheets

U.S. PATENT DOCUMENTS

| | | | | |
|---|---|---|---|---|
| 7,143,802 | B2 | 12/2006 | Strand et al. | |
| 7,159,635 | B2 | 1/2007 | Holt et al. | |
| 7,191,816 | B2 * | 3/2007 | Colson et al. | 160/84.05 |
| 7,513,292 | B2 * | 4/2009 | Auger et al. | 160/84.05 |
| 7,549,455 | B2 * | 6/2009 | Harper et al. | 160/121.1 |
| 7,571,756 | B2 * | 8/2009 | Smith et al. | 160/121.1 |
| 7,588,068 | B2 * | 9/2009 | Colson et al. | 160/121.1 |
| 7,637,301 | B2 * | 12/2009 | Forst Randle | 160/121.1 |
| 7,708,047 | B2 * | 5/2010 | Auger | 160/121.1 |
| 2001/0001414 | A1 | 5/2001 | Colson et al. | |
| 2001/0037864 | A1 * | 11/2001 | Colson et al. | 160/121.1 |
| 2002/0007923 | A1 * | 1/2002 | Colson et al. | 160/121.1 |
| 2002/0100562 | A1 * | 8/2002 | Ikle | 160/120 |
| 2002/0189771 | A1 | 12/2002 | Colson et al. | |
| 2004/0074611 | A1 | 4/2004 | Colson et al. | |
| 2004/0149396 | A1 * | 8/2004 | Colson et al. | 160/121.1 |
| 2004/0221967 | A1 * | 11/2004 | Ikle | 160/120 |
| 2005/0006034 | A1 * | 1/2005 | Judkins | 160/84.05 |
| 2005/0051281 | A1 | 3/2005 | Lai | |
| 2007/0039699 | A1 * | 2/2007 | Colson et al. | 160/121.1 |
| 2008/0053626 | A1 | 3/2008 | Jarosinski et al. | |
| 2008/0149280 | A1 * | 6/2008 | Smith et al. | 160/121.1 |
| 2008/0223532 | A1 | 9/2008 | Auger | |
| 2009/0263637 | A1 * | 10/2009 | Smith et al. | 428/212 |

FOREIGN PATENT DOCUMENTS

| | | | |
|---|---|---|---|
| WO | WO 2007/038447 | A2 | 4/2007 |

* cited by examiner

SYSTEM FOR OPERATING TOP DOWN/BOTTOM UP COVERING FOR ARCHITECTURAL OPENINGS

CROSS REFERENCE TO RELATED APPLICATION

The present application is a divisional of U.S. patent application Ser. No. 11/957,158 ("the '158 application), which was filed on Dec. 14, 2007, and entitled "System For Operating Top Down/Bottom Up Covering For Architectural-Openings", which claims the benefit under 35 U.S.C. §119(e) to U.S. Provisional Patent Application No. 60/871,015 ("the '015 application"), which was filed on Dec. 20, 2006, and entitled "System For Operating Top Down/Bottom Up Covering For Architectural Openings." The '015 and '158 applications are incorporated by reference into the present application in their entireties.

BACKGROUND OF THE INVENTION

1. Field of the Invention

The present invention relates generally to systems for operating coverings for architectural openings, such as doors, windows, archways and the like, wherein the covering is a top down/bottom up covering including a head rail, a bottom rail and a middle rail with a shade material extending between the middle and bottom rails. A single operating cord is utilized to raise and lower the middle and bottom rails independently of each other, but in one continuous motion so that the shade material can be deployed to any desired degree from the head rail down or from a bottom sill up.

2. A Description of the Relevant Art

Coverings for architectural openings have assumed many variations over a long period of time with early coverings simply being fabric draped across the architectural opening which could be a window, door, archway or the like. More recently, however, retractable coverings have been popular and have assumed numerous variations.

A popular retractable covering for architectural openings is a Venetian blind wherein a plurality of horizontally disposed slats are supported on cord ladders so that the blind can be extended across the covering or retracted adjacent one side. Further, when the blind is extended, the slats can be pivoted about their longitudinal axes between open and closed positions to permit or block vision and light through the blind.

Similarly, retractable vertical blinds have also been popular and are very similar to Venetian blinds, except the slats are vertically suspended rather than being supported horizontally. The slats can be gathered adjacent one side of the opening in a retracted position or extended across the opening in an evenly distributed array. Further, when the blind is extended, the slats can be rotated about their longitudinal vertical axes for pivotal movement between open and closed positions.

More recently, cellular blinds have become popular, which have assumed numerous forms including transversely collapsible cells that are interconnected along their length. The cells are typically disposed horizontally so in aggregate they form a panel of material that can be extended across the opening or gathered adjacent to one edge of the opening by transversely collapsing the cells. Other forms of cellular coverings have included a pair of transparent sheets of sheer fabric or the like which are interconnected at evenly spaced intervals by parallel vanes so as to form cells therebetween. By shifting the sheer fabrics in opposite vertical directions, the vanes can be opened or closed and the entire panel of material can be rolled or otherwise gathered adjacent one edge of the opening or extended across the opening.

More recently, retractable shades or blinds, where appropriate, have been designed so they include a head rail in which the control system for the blind is housed, a bottom rail, a middle rail and a shade material extending between the bottom rail and middle rail. The control system for the blind enables the bottom rail to be raised or lowered independently of the middle rail so that the shade material can be extended to any desired degree between the middle and bottom rails. The control systems for moving the middle and bottom rails so as to desirably position the shade material within the architectural opening have varied and typically include independent control systems for operating the middle rail and the bottom rail. These control systems might typically include a flexible control element at each end of the head rail.

It is to provide improvements in control systems for operating top down/bottom up coverings for architectural openings that the present invention has been developed.

SUMMARY OF THE INVENTION

The control system of the present invention is for operation of a top down/bottom up covering for an architectural opening. The covering includes a head rail for housing the operating components of the system, a horizontally disposed middle rail and a horizontally disposed bottom rail which can be raised or lowered independently to any location between the head rail and a fully deployed position adjacent a bottom sill of the opening. The system includes independent lift systems for the middle rail and for the bottom rail, but a common drive system for sequentially operating the lift systems for the middle rail and the bottom rail.

A single drive element disposed at one end of the head rail is utilized to operate both lift systems through a clutch that can be driven in reversible directions while maintaining a fixed position when not being driven.

When the covering is fully retracted with the middle rail and bottom rail positioned adjacent to the head rail and the shade material gathered therebetween, movement of the control element in one direction causes rotation of a drive shaft which sequentially fully lowers the bottom rail, then fully lowers the middle rail with either movement being terminable at any time. In other words, when the control element is moved in the first direction from the fully retracted position of the covering, the bottom rail will lower until the shade material is fully extended across the architectural opening with the bottom rail then positioned adjacent to the lower sill of the opening and the top rail remaining adjacent to the head rail. Continued movement of the control element in the first direction causes the middle rail to then lower until it is fully extended adjacent to the fully-extended bottom rail and to the bottom sill.

Rotation of the control element in the opposite direction will initially raise the middle rail from its fully extended position adjacent the bottom sill until it is fully raised and positioned adjacent to the head rail. Continued movement of the control element in the second direction will then raise the bottom rail until it is fully raised and positioned adjacent to the middle rail and the head rail.

It will be appreciated from the above the shade material can thereby be extended to any desired degree from either the head rail or from the bottom sill, and complete movement of the bottom rail and the middle rail from either a fully retracted position or a fully extended position is accomplished sequentially with rotation of the control element in a predetermined direction.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
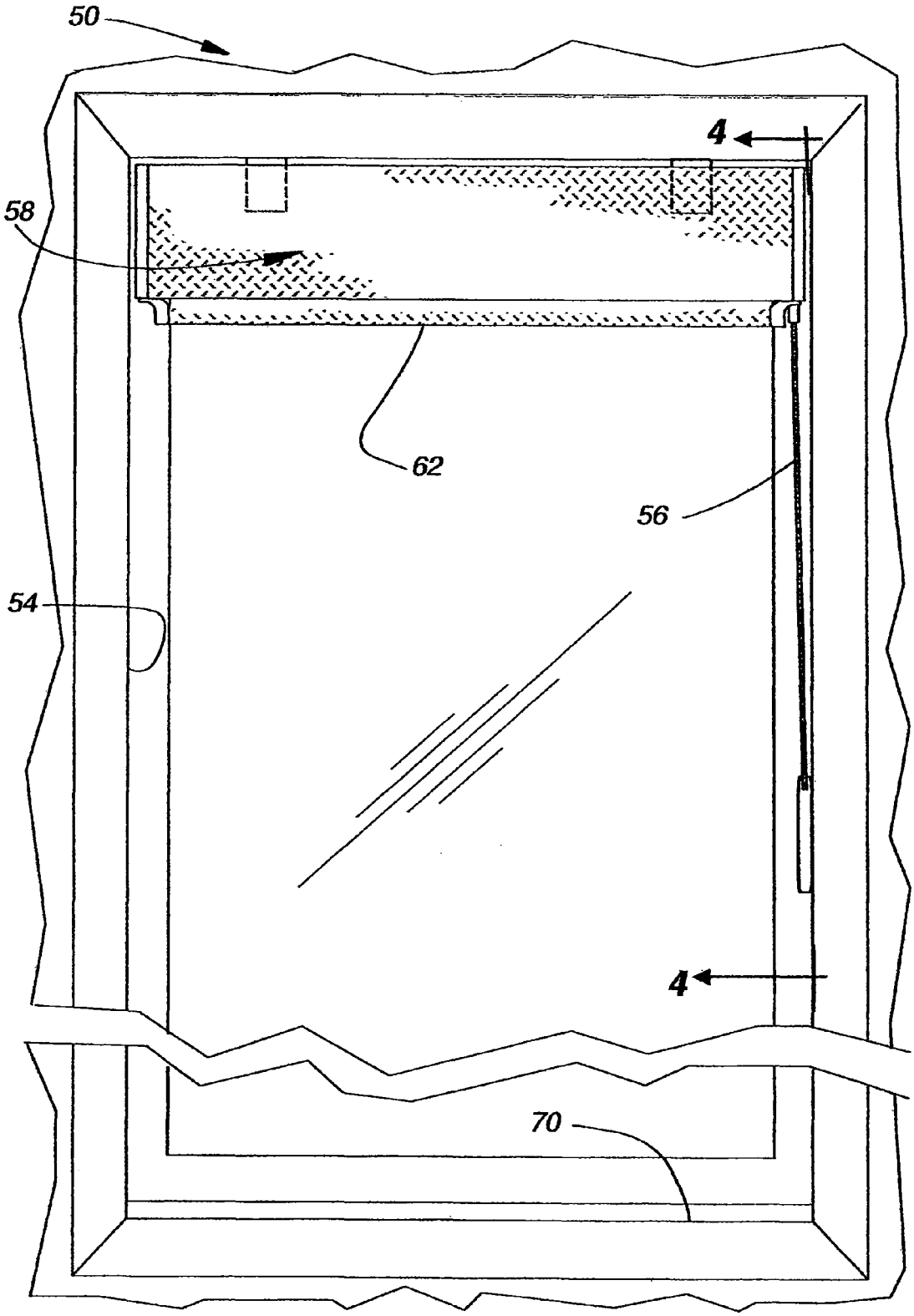
FIG. 1 is a front elevation of a covering in accordance with the present invention mounted in an architectural opening and with the covering in a fully retracted position.
Figure 2:
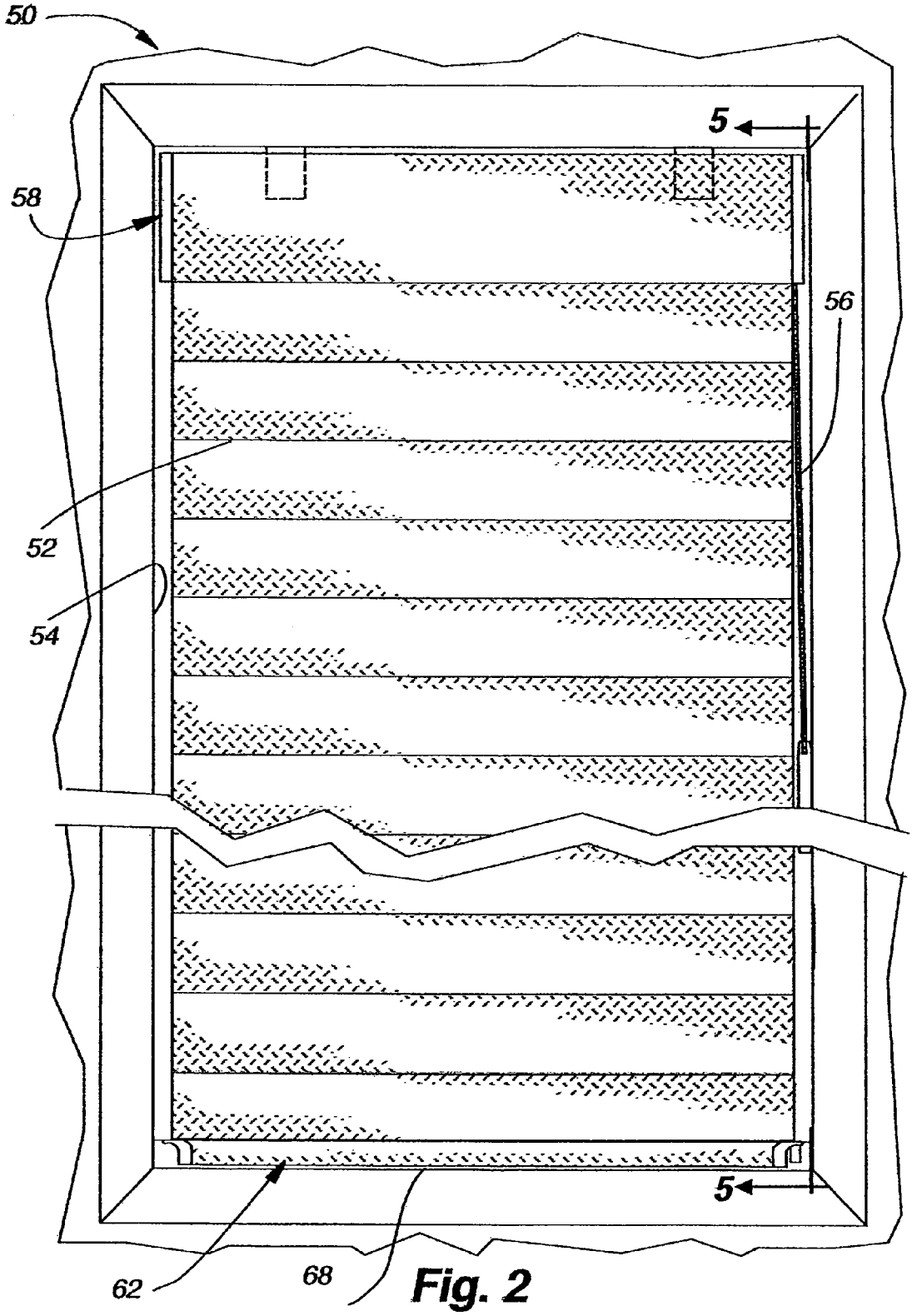
FIG. 2 is a front elevation similar to FIG. 1 with the covering in a fully extended position wherein the bottom rail is fully extended and the middle rail is fully retracted.

The present system 50 for controlling the operation of a top down/bottom up covering 52 (FIGS. 1-11) for an architectural opening 54 is operated with a single control element 56. The covering includes a head rail 58, a middle rail 60 and a bottom rail 62 with a flexible material 64 connected along a top edge 66 to the middle rail and along a bottom edge 68 to the bottom rail. The system is operative to independently move the bottom rail between a fully-extended position (FIGS. 2 and 3) adjacent a bottom sill 70 of the architectural opening and a fully-retracted position (FIG. 1) adjacent the head rail while sequentially moving the middle rail similarly between a fully-extended position (FIG. 3) adjacent the bottom sill and a retracted position adjacent the head rail (FIGS. 1 and 2). If a starting position of the covering has both the bottom rail and middle rail fully retracted adjacent to the head rail, movement of the control element 56 in a first direction would initially extend the bottom rail to its fully extended position adjacent the bottom sill 70, and in sequence thereafter, move the middle rail from the fully retracted position of FIGS. 1 and 2 to its fully extended position of FIG. 3 without changing the direction of movement of the control element. With both the bottom rail and middle rail fully extended, movement of the control element in a second or opposite direction would first raise the middle rail from its fully extended position to its fully retracted position and sequentially thereafter raise the bottom rail from its fully extended position to its fully retracted position without changing the direction of movement of the control element. Both the middle and bottom rails can be held in any position between being fully retracted or fully extended. It will therefore be appreciated the flexible material 64 extending between the middle rail and the bottom rail can be extended to any desired degree from the head rail or from the bottom sill as may be desired The control system 50 for effecting the afore-described operation includes not only the flexible control element 56, which is preferably a closed loop cord or the like, but also a two-way clutch system 72 that allows movement of the control element in either direction while retaining a fixed position when a force is not being applied to the control element. The output from the clutch system reversibly rotates an elongated horizontally disposed non-circular (in the preferred embodiment square) drive shaft 74 (FIGS. 16B-16D, 17, 18A and 18E) within the head rail 58 even though a keyed system could be used. The drive shaft operates two independent lift systems, with the first system referred to hereinafter as the spool lift system 76 for raising and lowering the middle rail 60 and the second lift system hereinafter referred to as the roller lift system 78 which raises and lowers the bottom rail 62. The spool lift system includes spool lift cords 79 (FIGS. 30, 31, 31A, 42, 43 and 45) extending from wrap spools 80 horizontally disposed within a roller 84 to the middle rail, while roller lift cords 82 (FIGS. 41, 43 and 46) extend from the roller 84 within the head rail to the bottom rail with the roller being adapted to have the flexible material 64 wrapped therearound when the covering is not fully extended.

The spool lift system 76 is operative to wrap the spool lift cords 79 therearound when retracting the middle rail 60 or to allow the spool lift cords to unwrap from the spools when the middle rail is lowered. There are at least two lift spool systems 76 and depending upon the width of the covering, additional lift spool systems could be utilized. For purposes of the present disclosure, however, only two lift spool systems are shown.

The roller 84 for the roller lift system 78 extends substantially the full width of the covering with the roller lift system being operative from only one end of the roller. There are at least two roller lift cords or guide cords 82, depending upon the width of the covering, while additional roller lift cords could be provided if the width of the roller or the covering necessitated such. Each roller lift cord has its upper end operatively connected to the roller and its lower end connected to the bottom rail 62 so as to extend co-extensively with the flexible material 64. Accordingly, when the roller is rotated and the bottom rail is fully extended, the sheet material and the roller lift cords wrap simultaneously about the roller until the bottom rail is fully retracted, at which point the roller lift cords can no longer be raised and the covering is fully retracted with both the middle rail 60 and bottom rail 62 adjacent to the head rail 58.

Pursuant to the above, it will be appreciated that with both the bottom rail 62 and middle rail 60 fully retracted adjacent to the head rail 58, and movement of the control cord or element 56 in a first direction, the roller 84 can be rolled in a first direction causing the bottom rail to drop by gravity or extend until it is positioned adjacent to the bottom sill 70 and immediately thereafter, the middle rail will begin to descend from its fully retracted position toward its fully extended position. Accordingly, during this sequence of operations, the flexible sheet material 64 is initially fully extended across the architectural opening with the bottom rail adjacent the bottom sill and the middle rail adjacent the head rail and subsequently, as the middle rail drops from its fully retracted position toward its fully extended position, the sheet material gathers between the middle and bottom rails establishing an opening or space between the middle rail and the head rail through which vision and light can pass. Once the middle rail is fully extended adjacent to the fully-extended bottom rail, the sheet material is fully gathered between the bottom and middle rails and the opening or space is open for full passage of vision and light.

In reverse, when the operating element 56 is pulled in the opposite direction, the middle rail 60 is first raised from its fully-extended position toward its fully-retracted position, thereby diminishing the size of the opening or space through which vision and light can pass until the middle rail is fully retracted with the flexible sheet material 64, again fully extending across the architectural opening. Continued movement of the operating element in the second direction then begins raising the bottom rail 62 toward the middle rail as in a bottom up operation of the system so the flexible sheet material is again gathered between the middle rail and the bottom rail until it is fully gathered with both the middle and bottom rails fully retracted and positioned adjacent to the head rail allowing full vision and light to pass between the bottom rail and the sill.

For purposes of the present disclosure, the flexible sheet material 64 interconnecting the middle rail 60 and bottom rail 62 includes two sheets of material with one sheet being a flexible backing sheet 86 of generally planar configuration when the covering is fully extended across the architectural opening 54 and the second sheet being a flexible front sheet 88 interconnected with the backing sheet along horizontal lines of attachment 90 at vertically spaced locations so as to define horizontally extending loops 92 in the front sheet simulating a Roman shade. It will be understood with the description of the system hereafter, however, that various flexible materials could be utilized in lieu of the material illustrated which is shown for exemplary purposes only.

Further, since the middle rail 60 can be raised or lowered while the bottom rail 62 is fully extended with the roller lift cords 82 associated with the bottom rail extending from the head rail 58 to the bottom rail, the middle rail needs to slide along the roller lift cords. Accordingly, with the flexible sheet material 64 of the type illustrated, the horizontal lines of attachment 90 are provided with gaps 94 at locations vertically aligned with the roller lift cords 82 so gaps in each horizontal line of attachment are established through which a roller lift cord can be slidably extended so that the middle rail can be raised or lowered while the roller lift cords are static and fully extended with the middle rail and the top edge 66 of the flexible sheet material merely sliding along the roller lift cords.

Figure 13:
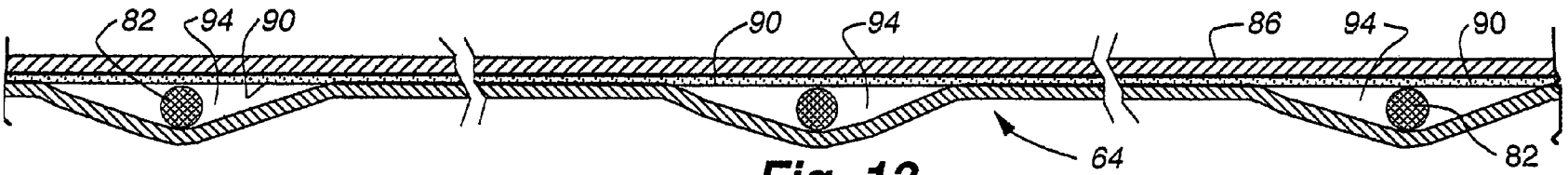
FIG. 13 is an enlarged section taken along line 13-13 of FIG. 11.
Figure 14:
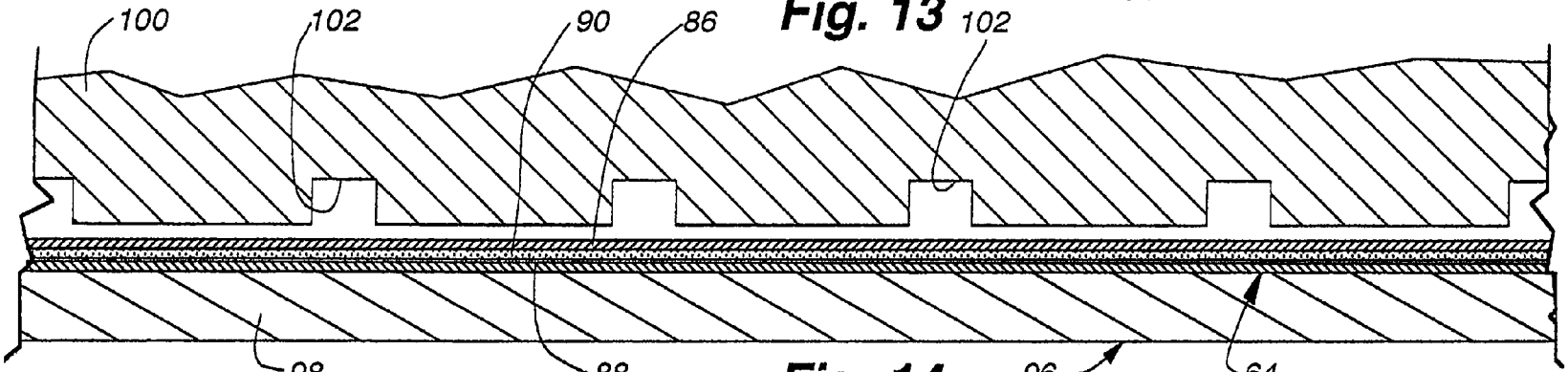
FIG. 14 is a vertical section through a heat-sealing press in a non-engaging position showing an initial step in the formation of the shade material used in the covering of the present invention.
Figure 15:
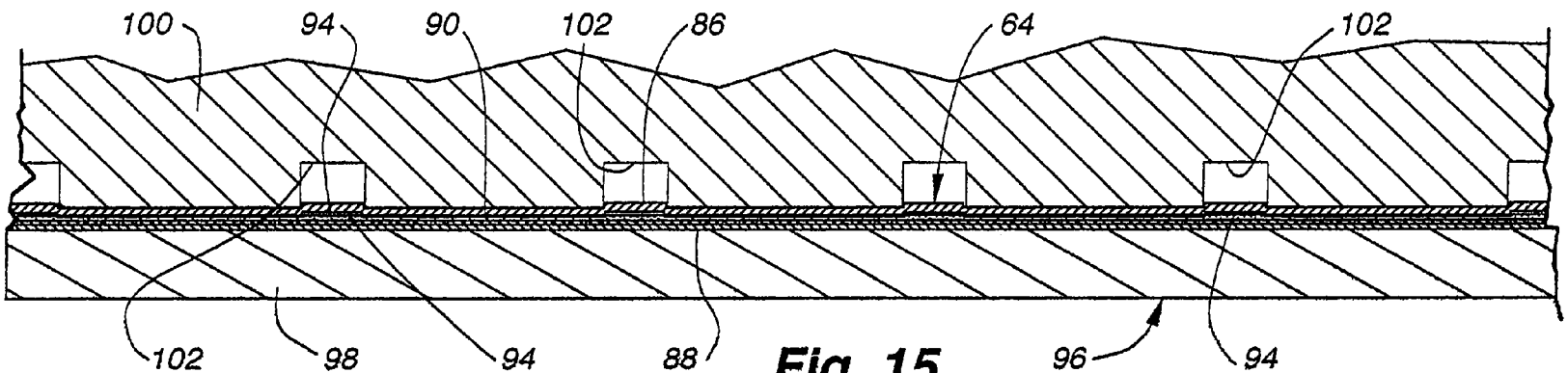
FIG. 15 is a section similar to FIG. 14 with the heat press in an engaging position.

With reference to FIGS. 13, 14 and 15, this relationship of the roller lift cords 82 with the flexible sheet material 64 is illustrated. The adhesive lines 90 are in reality hot-melt adhesive and extend continuously across the full width of the interior face of the backing sheet 86. In order to secure the back sheet 86 of material to the front sheet, the hot-melt adhesive, which is non-tacky or inert when it is cool, is heated and thereby activated where it is desired the front and back sheets be adhesively secured. Where it is not desired that the front and back sheets be adhesively secured, i.e., so as to define the gaps 94 through which the roller lift cords 82 can extend, heat is not applied to the adhesive, which, as mentioned above, is non-tacky until activated with heat.

With reference to FIGS. 14 and 15, a system 96 is illustrated for selectively activating portions of the hot-melt adhesive strips or lines 90 so the front 88 and back 86 sheets are selectively adhered to each other defining the gaps 94 through which the roller lift cords 82 can pass. A flat ultrasonic horn 98 can be provided to continuously support the front and back laminates of the sheet material 64 with the adhesive lines or strips having previously been applied to the front sheet of material. An overhead backing plate or anvil 100 can then be lowered into engagement with the laminates to permit ultrasonic activating of the adhesive at the desired locations. The anvil has channels 102 formed therethrough where ultrasonic waves dissipate so that heat is not applied to the laminate materials where the laminate materials are in alignment with the channels. The materials are therefore not bonded at the channel locations, as the adhesive is not activated at these locations. These locations of course define the gaps through which the roller lift cords can pass, but at all other locations along the adhesive strips, the front and back sheets are adhesively secured so that the loops 92 of fabric are defined in the front sheet rendering a decorative dropped appearance to the flexible sheet material. The selective activation of the adhesive could be achieved with other systems such as ultrasonics, for example.

Figure 16A:
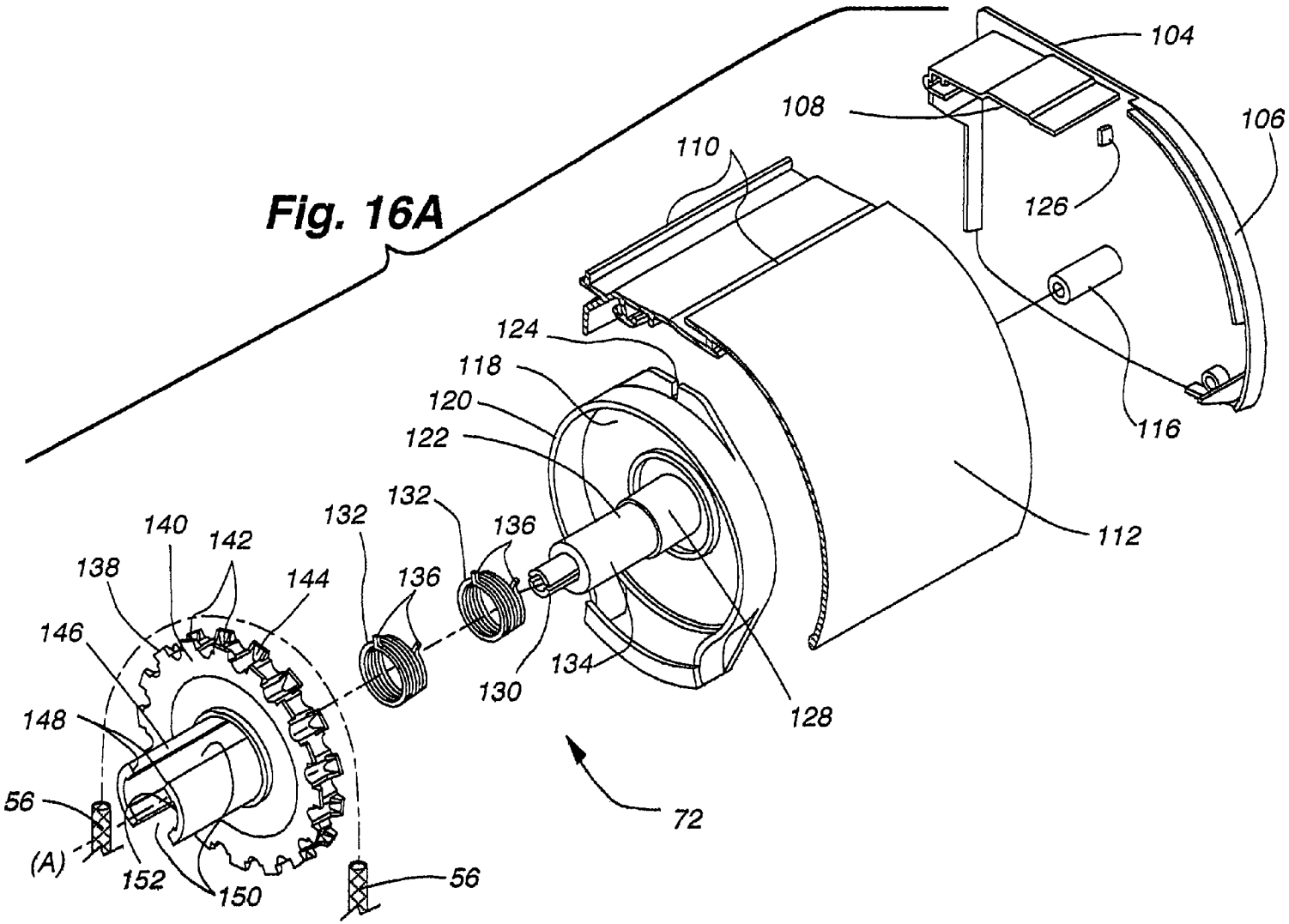
FIG. 16A is an exploded isometric showing the right end of the head rail with operative components of the control system.
Figure 16B:
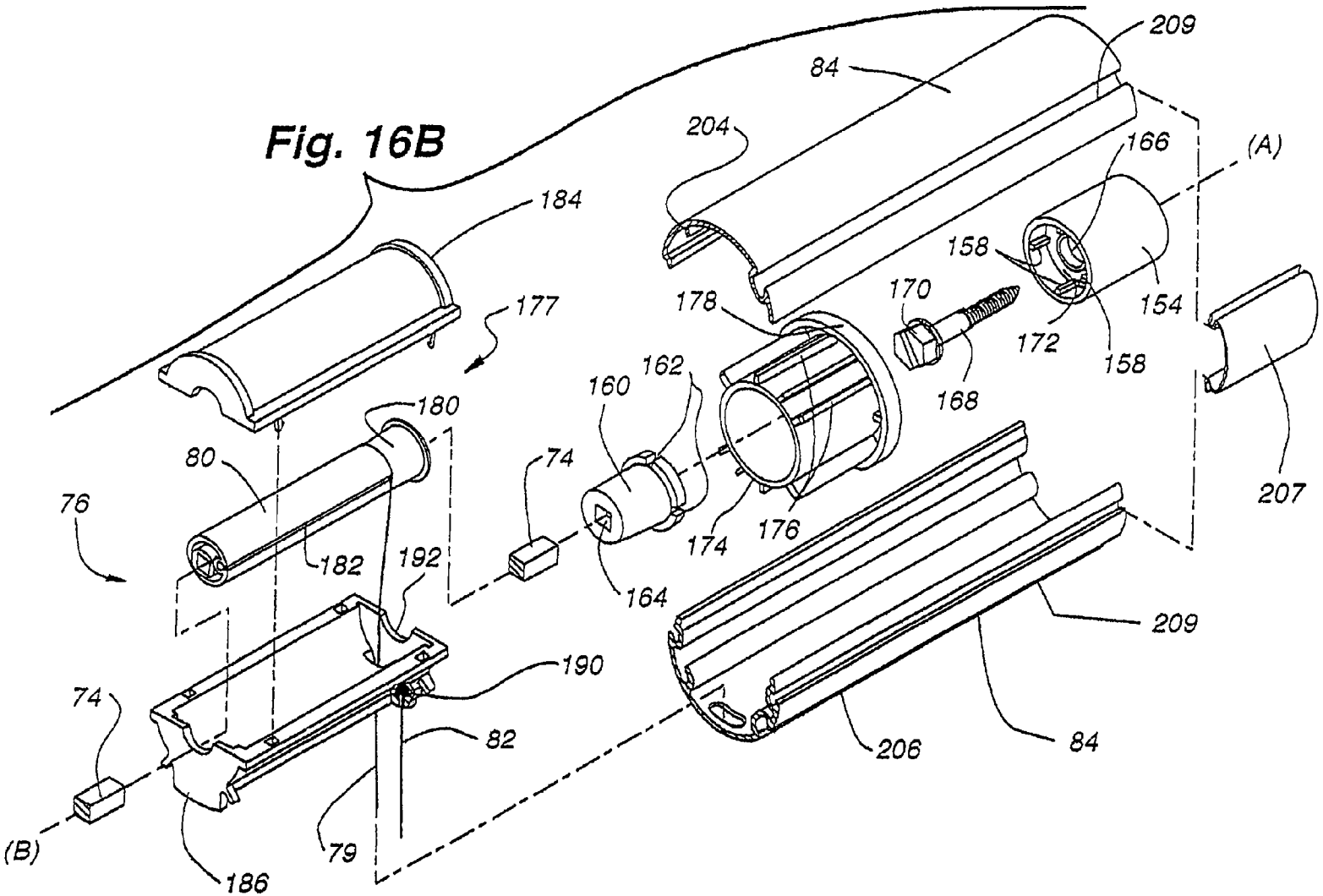
FIG. 16B is an exploded isometric of a section of the head rail and control system immediately to the left of that shown in FIG. 16A.
Figure 16C:
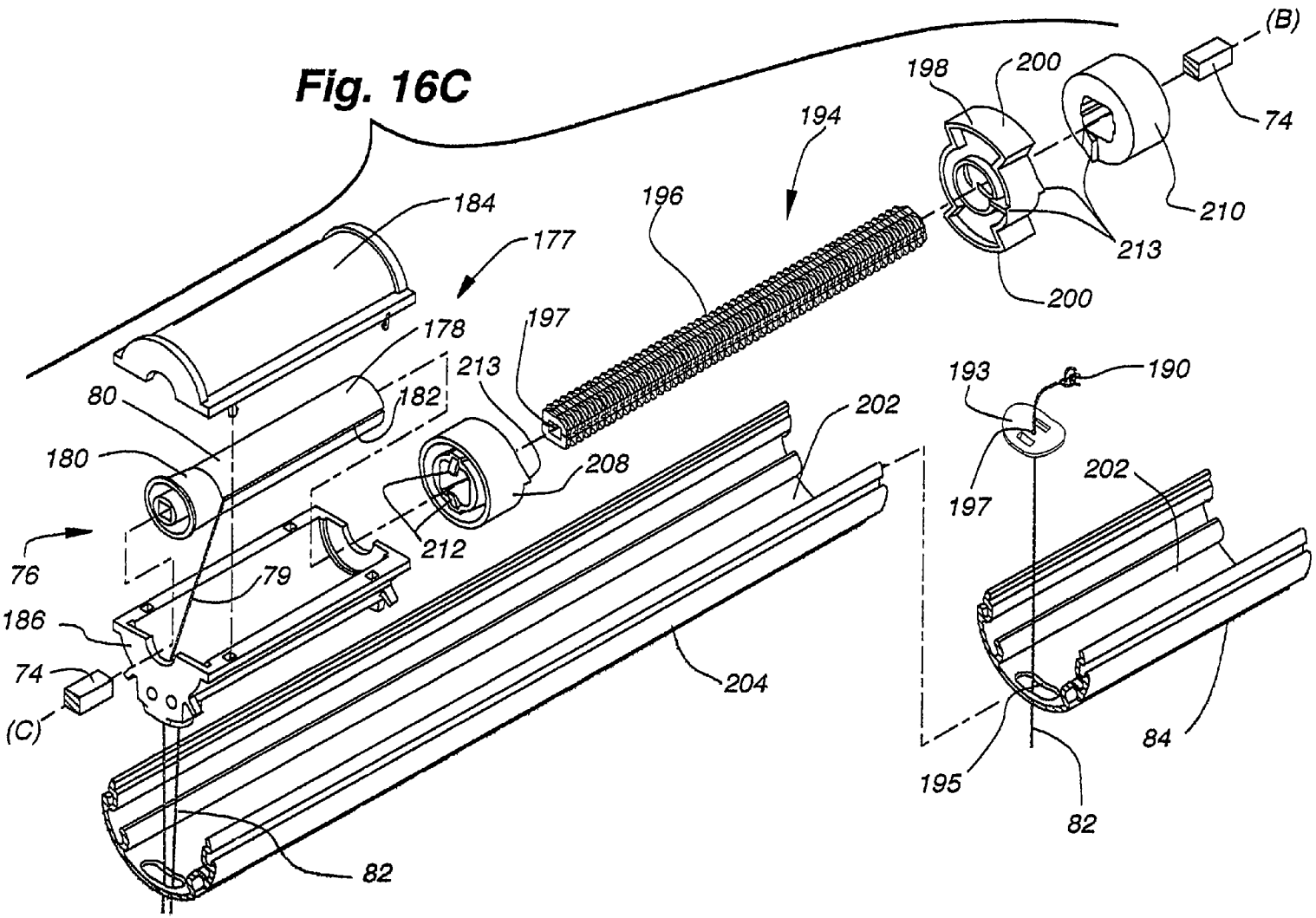
FIG. 16C is an exploded isometric of the head rail and components housed therein immediately to the left of that shown in FIG. 16B.
Figure 17:
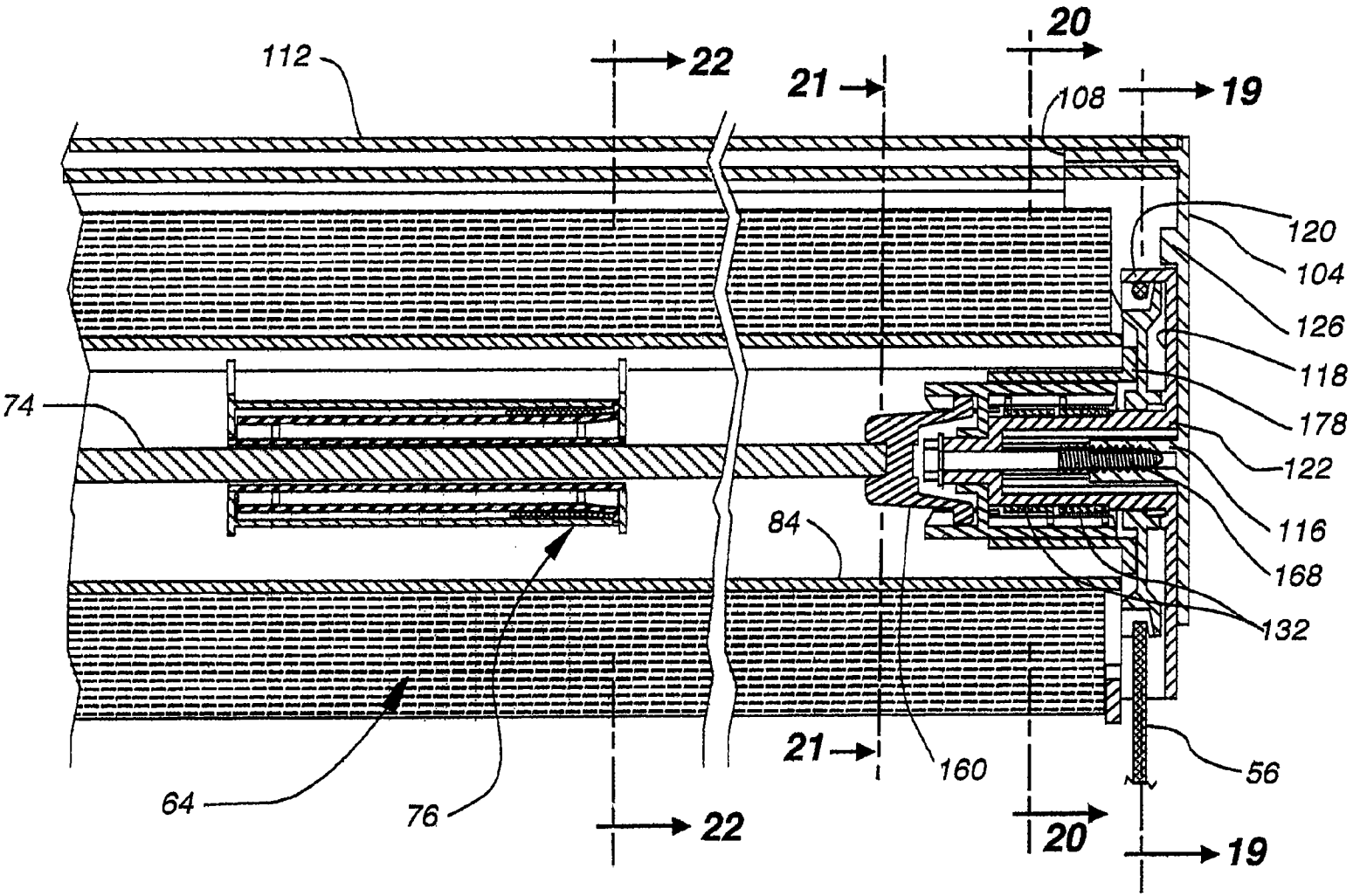
FIG. 17 is an enlarged section taken along line 17-17 of FIG. 4.
Figure 18A:
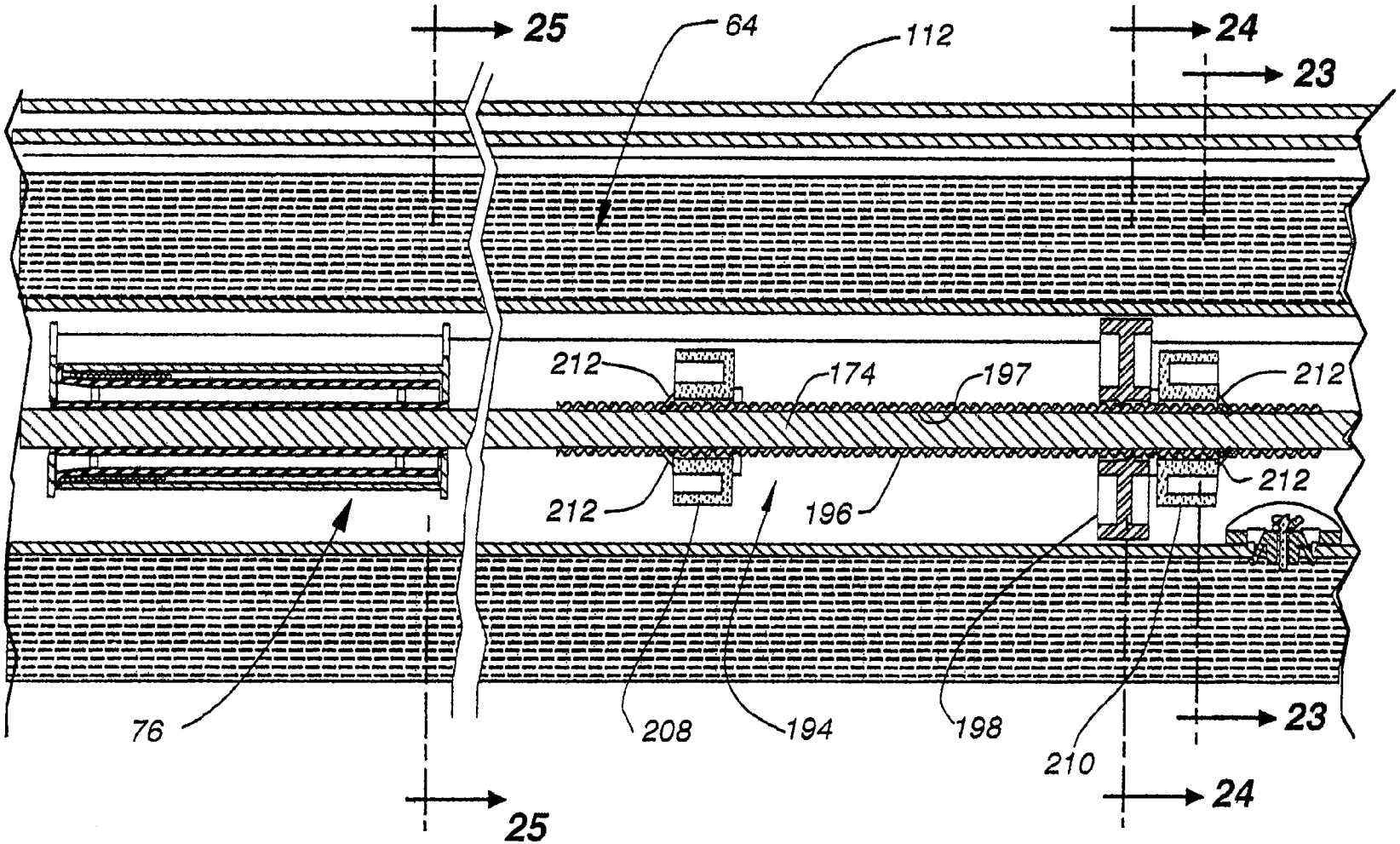
FIG. 18A is an enlarged section taken along line 18A-18A of FIG. 4.
Figure 18B:
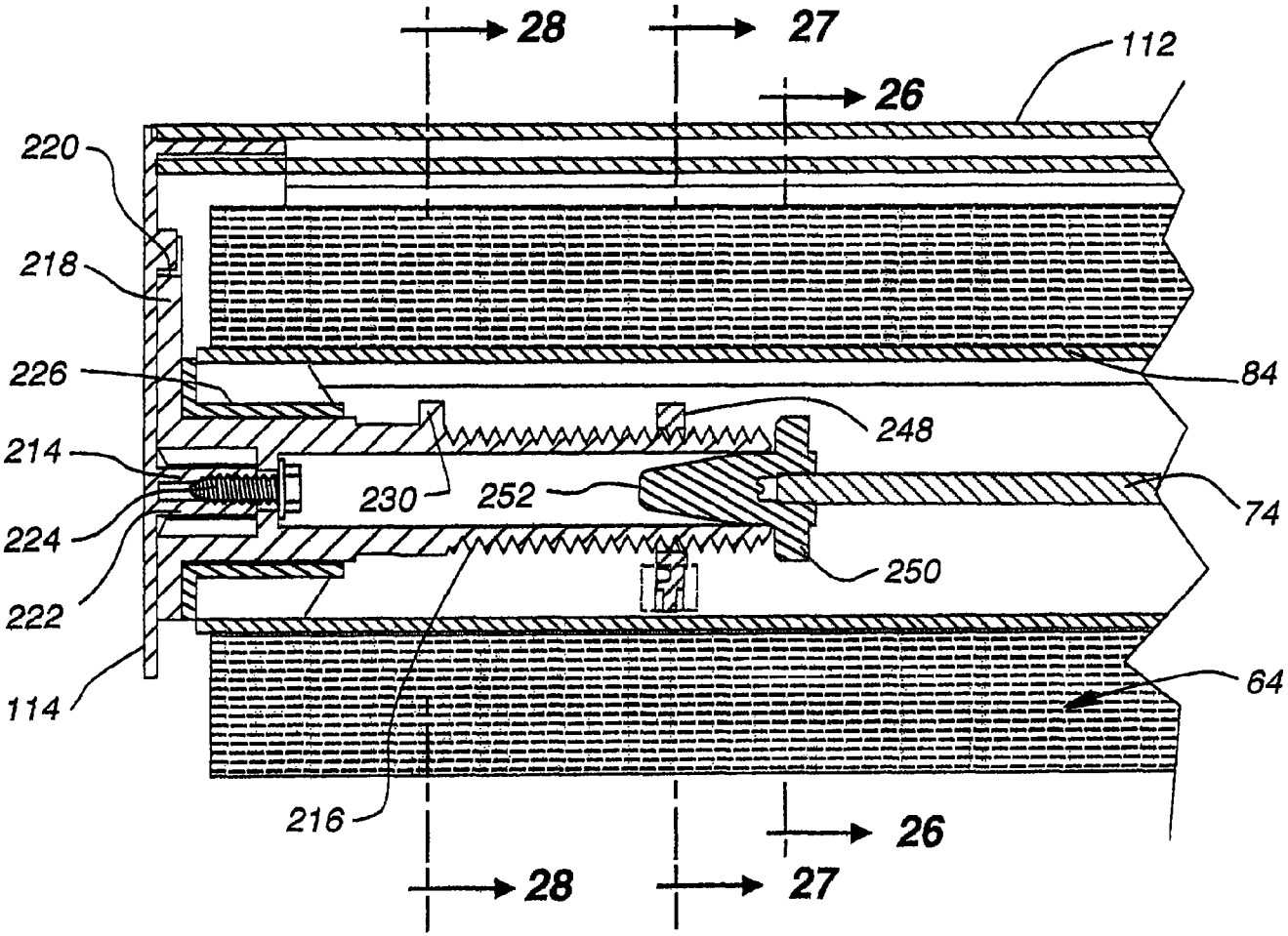
FIG. 18B is an enlarged section taken along line 18B-18B of FIG. 4.
Figure 19:
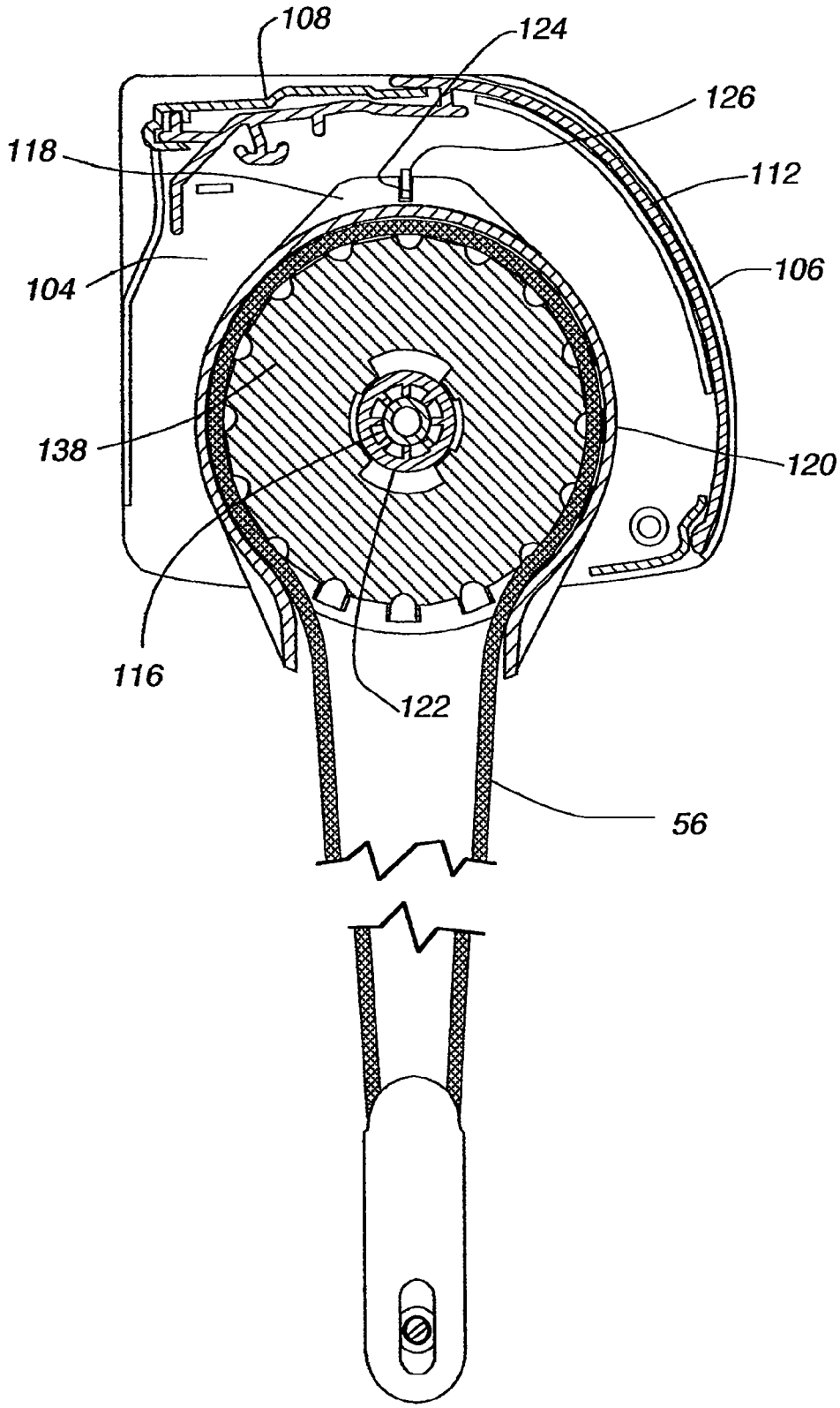
FIG. 19 is a section taken along line 19-19 of FIG. 17.
Figure 20:
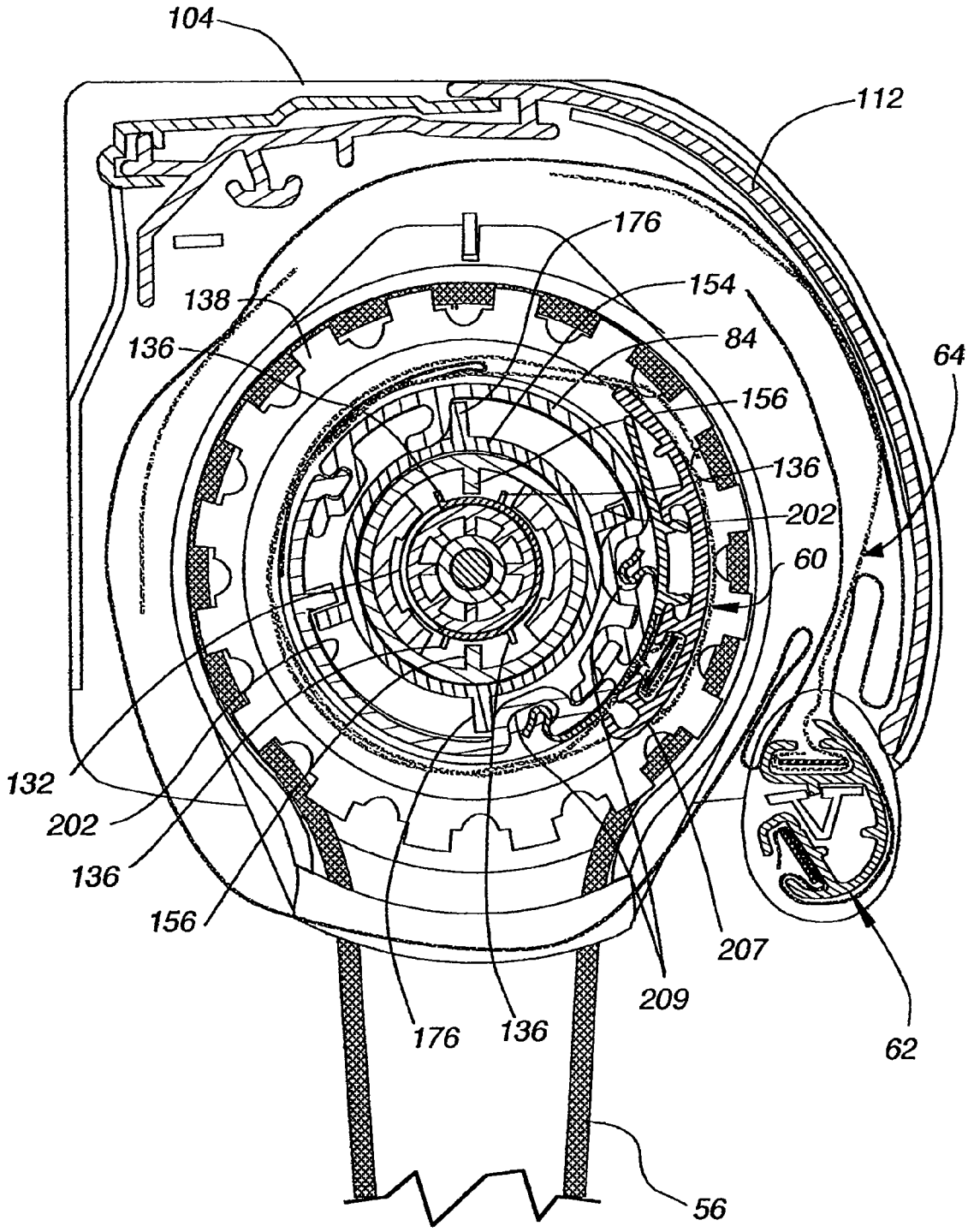
FIG. 20 is a section taken along line 20-20 of FIG. 17.
Figure 21:
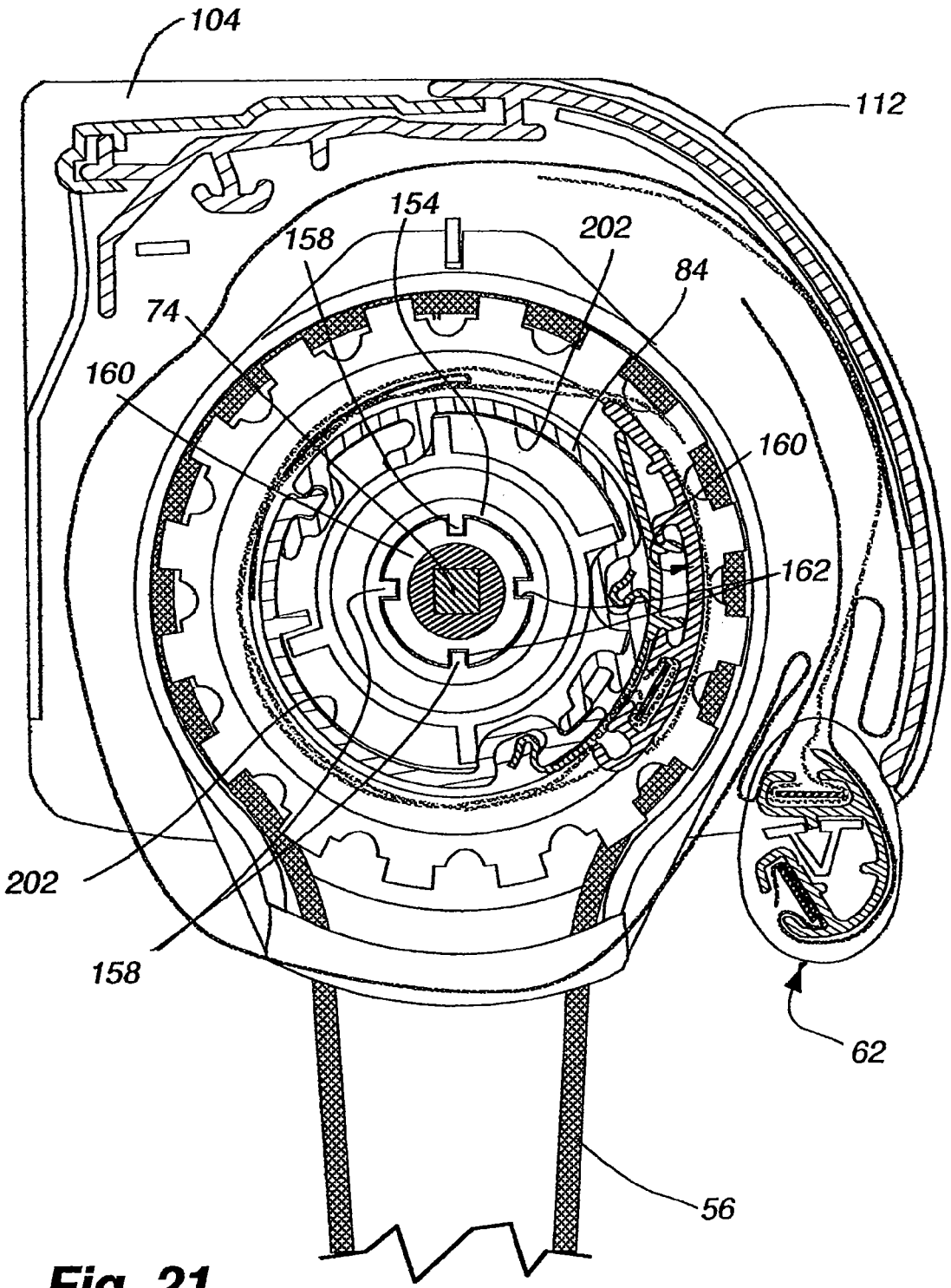
FIG. 21 is a section taken along line 21-21 of FIG. 17.
Figure 22:
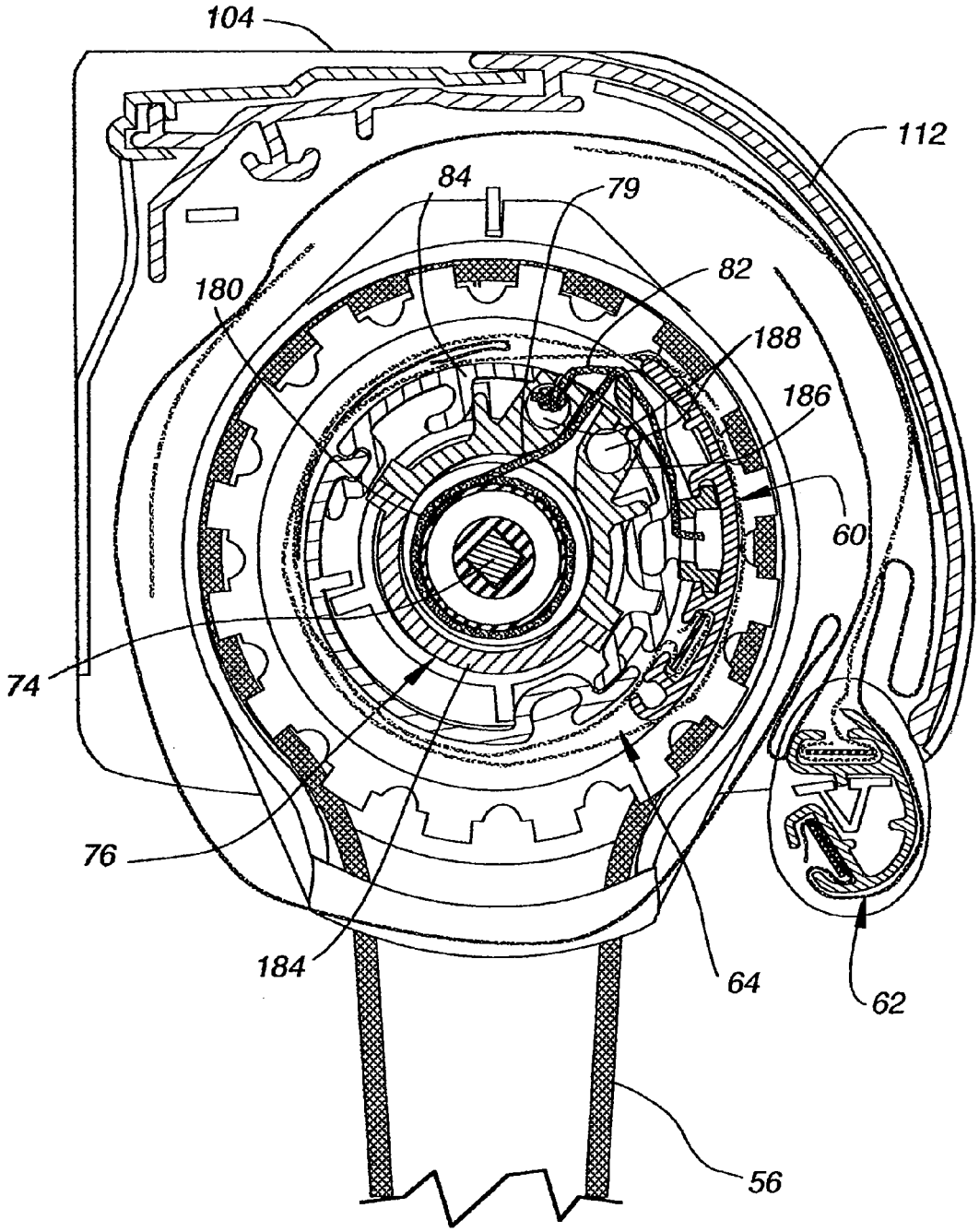
FIG. 22 is a section taken along line 22-22 of FIG. 17.
Figure 23:
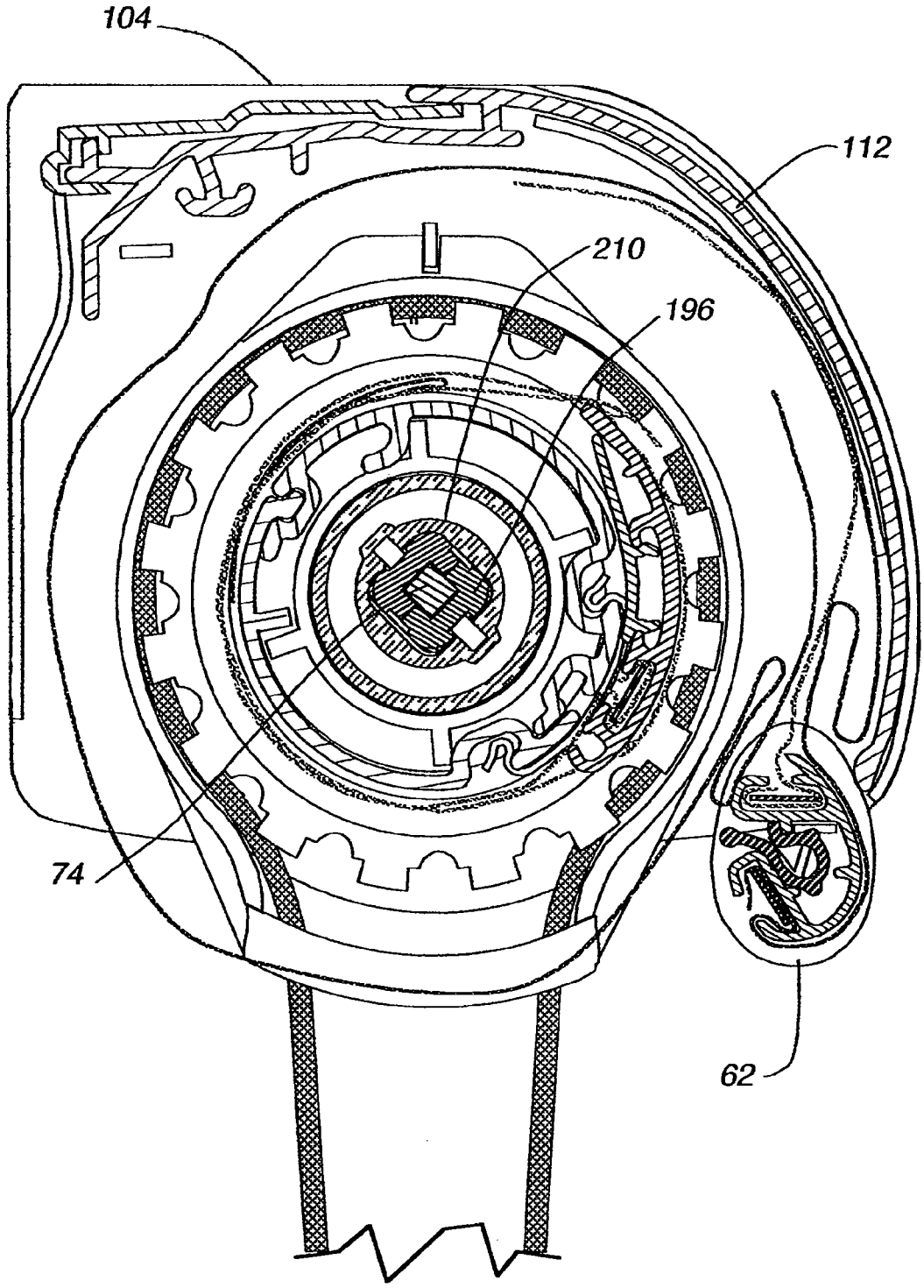
FIG. 23 is a section taken along line 23-23 of FIG. 18A.
Figure 24:
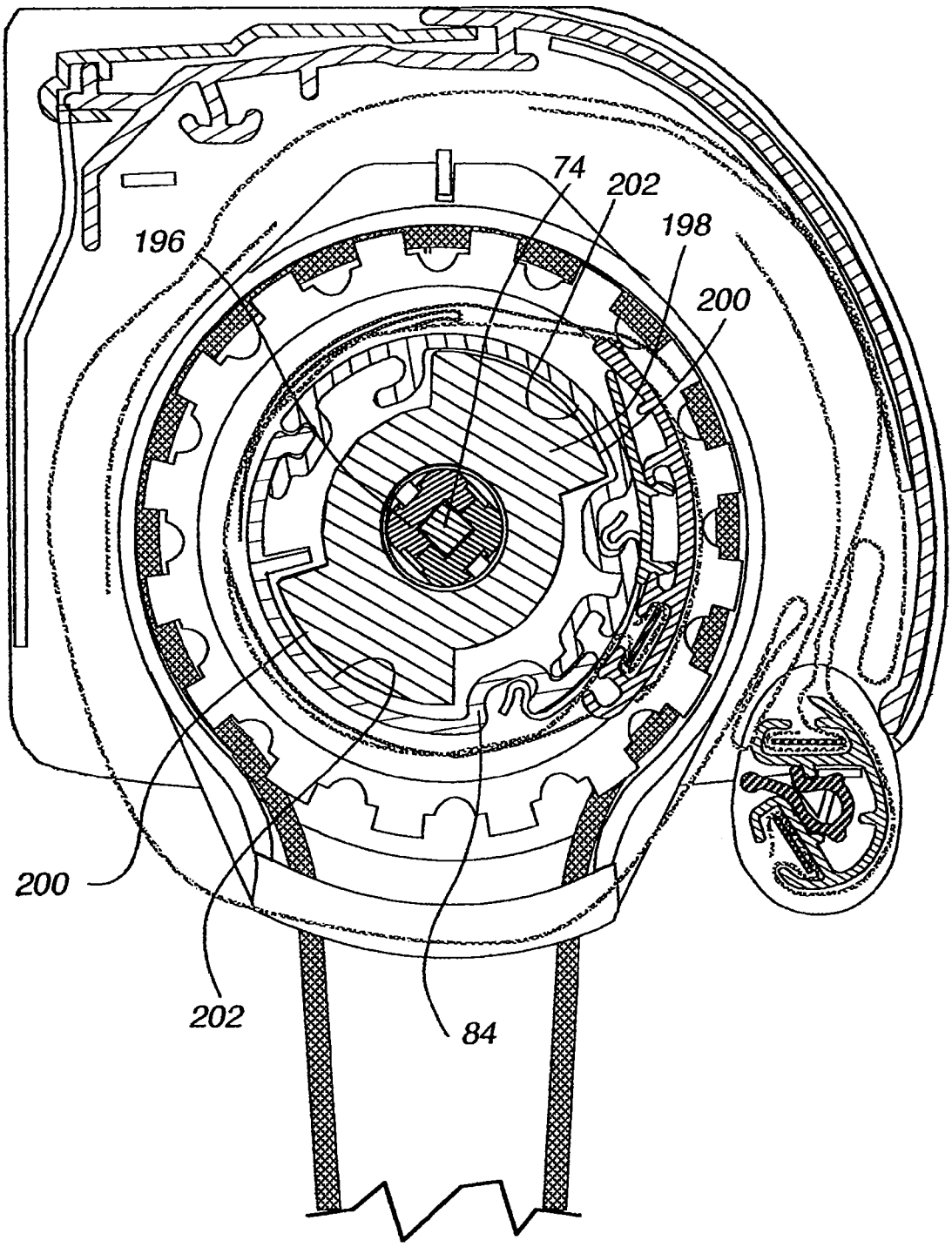
FIG. 24 is a section taken along line 24-24 of FIG. 18A.
Figure 25:
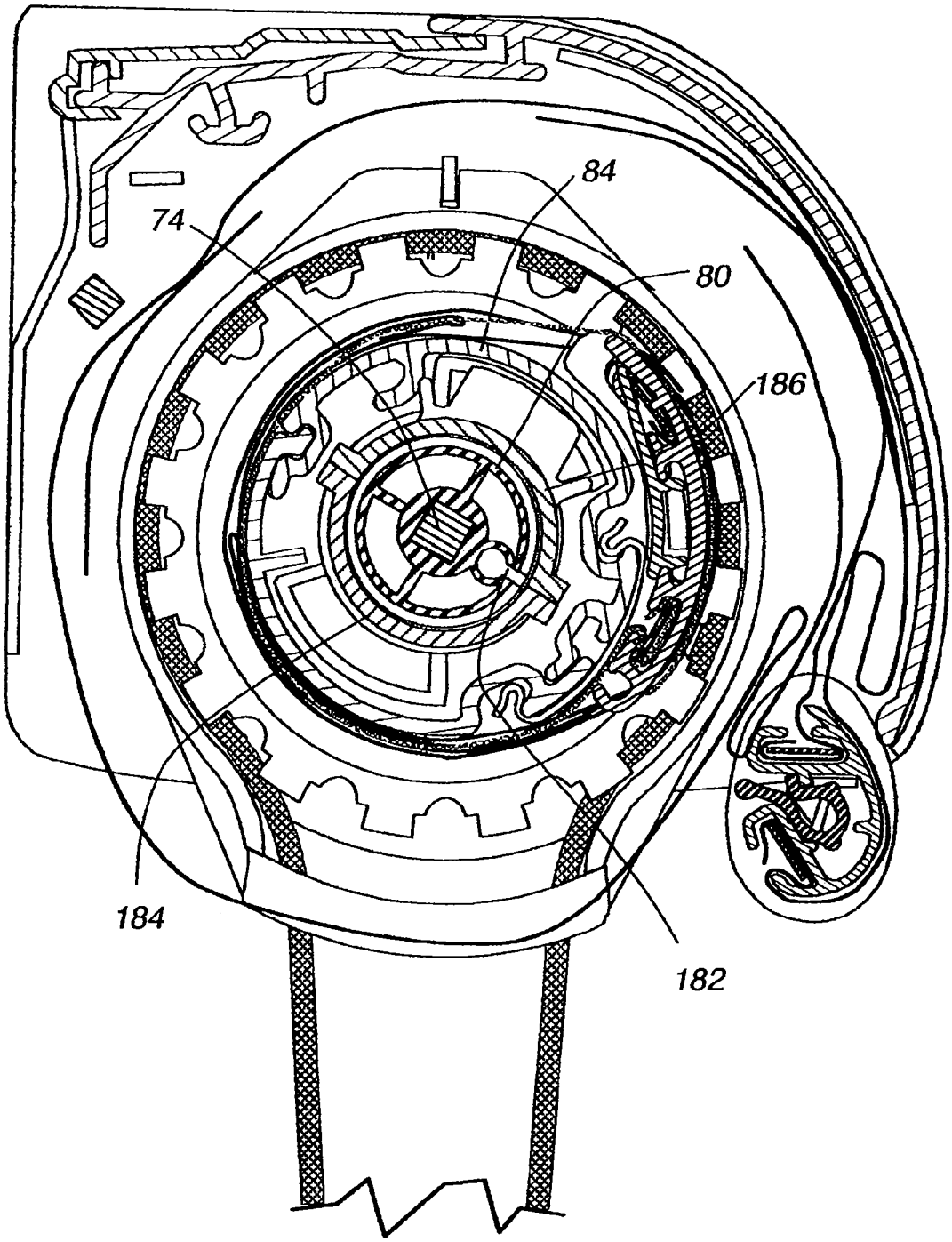
FIG. 25 is a section taken along line 25-25 of FIG. 18A.
Figure 26:
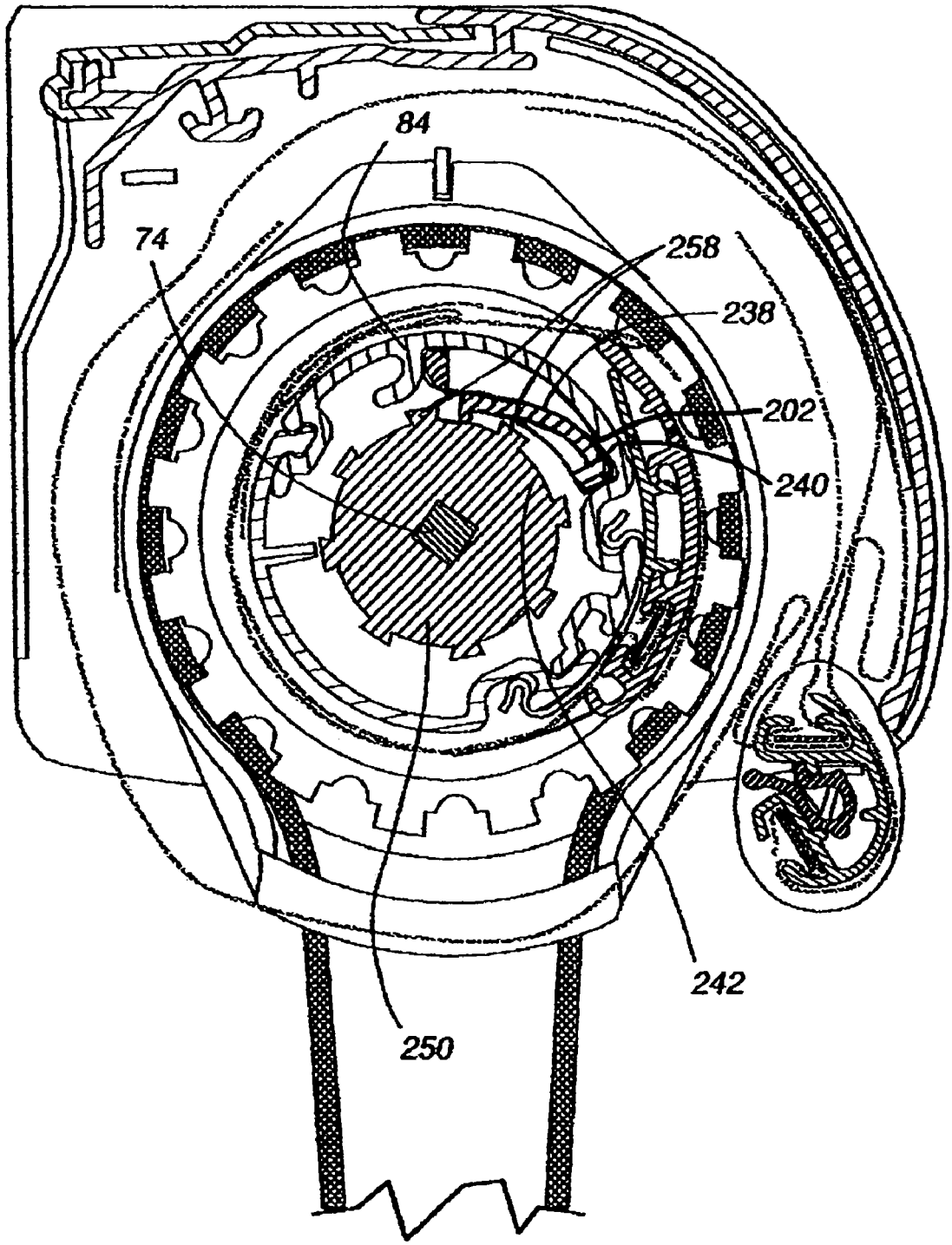
FIG. 26 is a section taken along line 26-26 of FIG. 18B.
Figure 27:
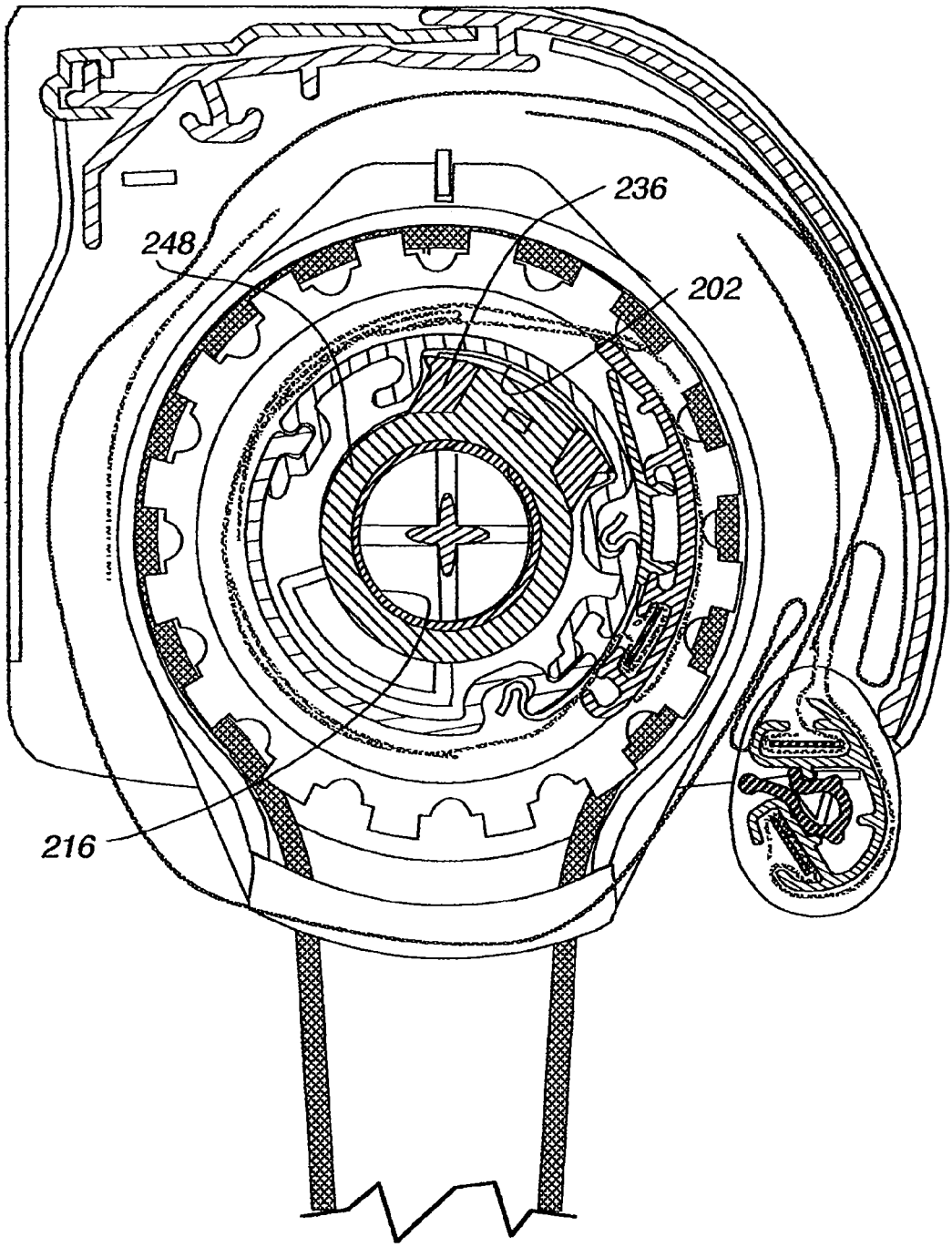
FIG. 27 is a section taken along line 27-27 of FIG. 18B.
Figure 28:
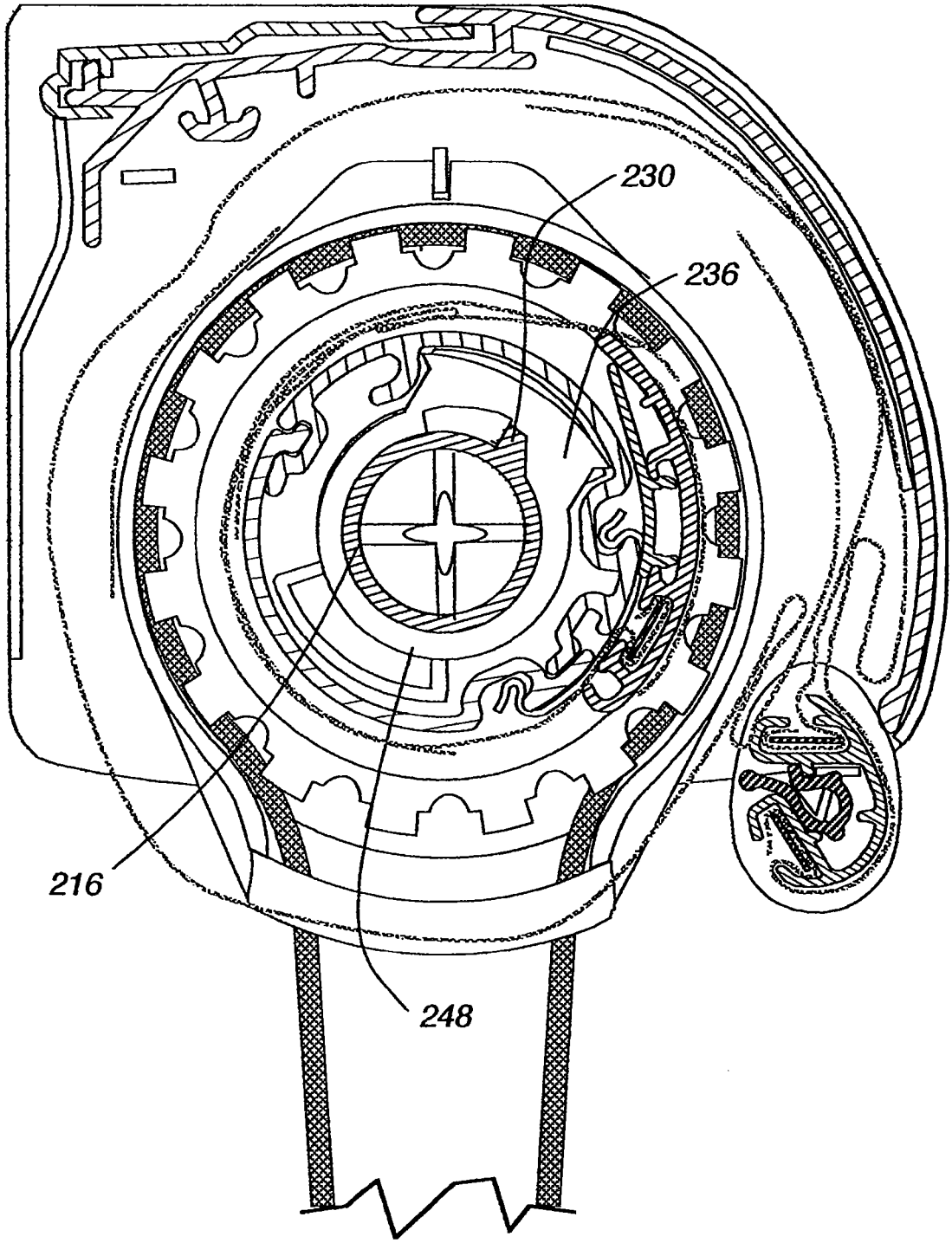
FIG. 28 is a section taken along line 28-28 of FIG. 18B.
Figure 29:
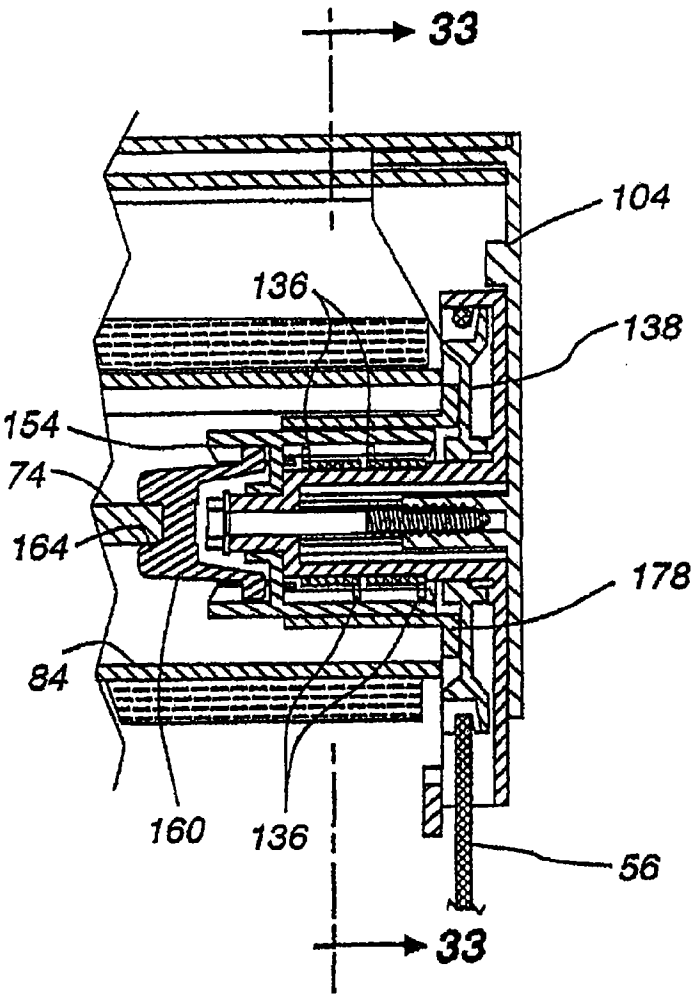
FIG. 29 is an enlarged section taken along line 29-29 of FIG. 5.
Figure 30:
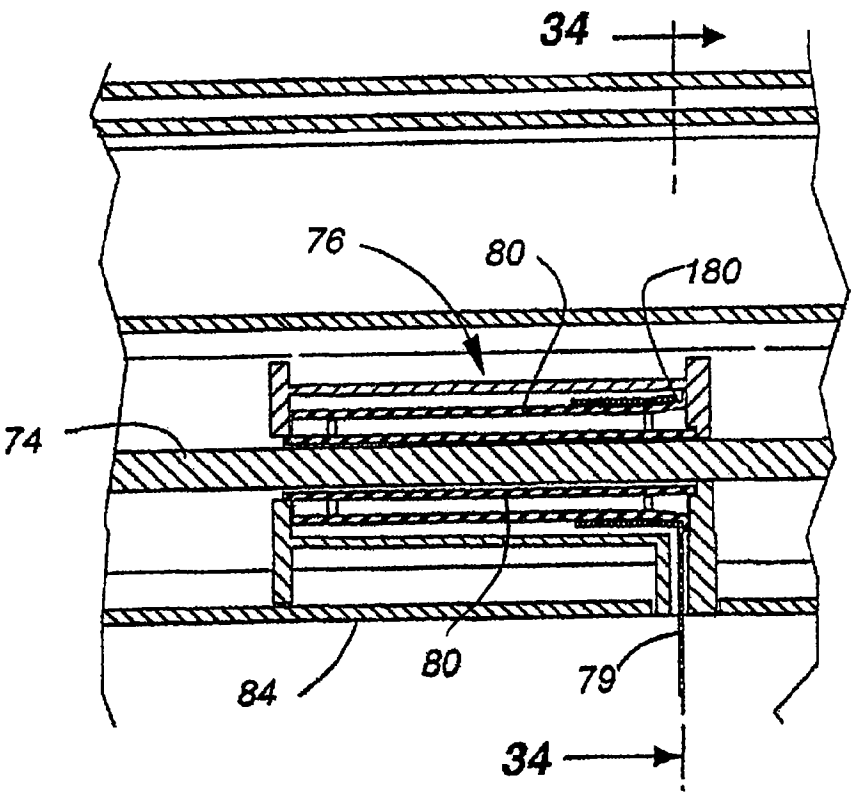
FIG. 30 is an enlarged section taken along line 30-30 of FIG. 5.

Referring to FIG. 16A through 16D, the operative components of the system 50 of the present invention commencing at the right end of the head rail 58 as viewed in FIG. 1 are illustrated in an exploded isometric format. The same components are shown assembled in FIGS. 17, 18A and 18B with FIG. 17 showing the assemblage of the parts shown in FIGS. 16A and 16B, FIG. 18 showing the assemblage of the parts shown in FIG. 16C and FIG. 18B showing the assemblage of the parts shown in FIG. 16D. Further, in FIGS. 17, 18A and 18B, various section lines are shown to further illustrate the assemblage of the components with the sectional views being FIGS. 19-28.

Referring to FIG. 16A, a right end cap or plate 104 is illustrated to be of generally planar configuration having an arcuate front edge 106 which faces the interior of a room in which the covering 52 is mounted. The right end cap has along its upper rear edges a tabular inward projection 108 which is adapted to coordinate and mate with a formation 110 on an outer housing 112 for the head rail so the housing can be retained on the right end cap, and as will be explained hereafter, similarly on the left end cap 114 shown in FIG. 16D. Further, the right end cap has a stub shaft 116 with a hollow interior on which a mounting plate 118, having a generally circular inwardly projecting rim 120 and hollow support shaft 122 is mounted. The mounting plate has a slot 124 along a top edge thereof adapted to receive an inwardly projecting tab 126 on the right end cap so that the mounting plate is prevented from rotative movement relative to the right end cap.

The support shaft 122 has three cylindrical segments of differing diameters with the outermost segment 128 being of the largest diameter and the innermost segment 130 of the smallest diameter. The support shaft is hollow all the way through and communicates with the hollow interior of the stub shaft 116. The stub shaft supports the mounting plate 118 in a fixed position. A plurality of identical coil springs 132 (two being shown) fit snuggly on the intermediate segment 134 of the support shaft 122 in a rest condition with each coil spring having radially outwardly projecting tangs 136 at opposite ends. The tangs at opposite ends of each coil spring are also circumferentially displaced a small angular amount so that movement of the tangs toward each other will enlarge the effective diameter of the springs from their rest diameter or condition so they can be rotated when desired about the cylindrical support shaft on which they are mounted. As will be appreciated with the description that follows, the coil springs form part of the two-way clutch system 72 which could be of the type disclosed in detail in U.S. Pat. No. 4,372,432 issued Feb. 8, 1983. This patent is incorporated herein by reference.

Mounted on the coil springs 132 for unitary movement therewith is a drive wheel 138 having a disk-like segment 140 with a peripheral edge having raised segments 142 defining a peripheral channel 144 in which the operating or control element 56 in the form of an endless flexible cord can be disposed for gripping engagement with the drive wheel. The drive wheel also has a bifurcated shaft 146 defined by two spaced arcuate segments 148 with the arcuate segments defining diametrically opposed elongated slots 150 therebetween of a width to receive the tangs 136 of the coil springs 132 without moving the tangs from their rest position which they assume when they are gripping the intermediate segment 134 of the support shaft on the mounting plate. As will be appreciated with the description that follows, however, movement of the drive wheel in either direction will cause an edge of one of the arcuate shaft segments 148 to engage one or the other of the tangs on the coil springs urging that tang toward the opposite tang of the associated spring to thereby enlarge the effective diameters of the coil springs so they are free to rotate about the intermediate segment 134 of the support shaft. The two slots 150 are provided in the drive wheel for ease of assemblage with it only being important that one such slot be provided to receive the tangs of the coil springs. As is evident, the bifurcated shaft defines a generally cylindrical passage 152 therethrough having a diameter slightly greater than the outer diameter of the coil springs, but less than that of the tangs on the coil springs. Further it should be appreciated the outer periphery of the disk portion 140 of the drive wheel 138 is slightly smaller than the internal diameter of the rim 120 around the mounting plate 118 so that a space is defined between the perimeter of the drive wheel disk and the rim of the support plate in which the flexible control element 56 can be confined for positive engagement with the drive wheel.

Referring next to FIG. 16B, a bearing spacer 154 of cylindrical configuration is adapted to be seated on the outer arcuate surfaces of the bifurcated shaft segments 148 with the spacer including a pair of internal diametrically opposed ribs 156 (FIG. 20), one of which fits between the tangs 136 of the coil springs 132 so that the spacer will rotate with the springs and the drive wheel 138. The spacer further has four inwardly directed circumferentially spaced tabs 158 at its opposite or inner end adapted to mate with a coupler 160 having a disk-like end with four slots 162 adapted to receive the four tabs 158 on the spacer. The coupler has a square opening 164 in an inner end thereof to receive an end of the square drive shaft 74 as will be explained hereafter. The spacer has a cylindrical passage 166 therethrough adapted to receive a screw-type fastener 168 having an enlarged head 170, which remains seated in a cavity 172 in the inner end of the spacer where the four circumferentially spaced tabs 158 are provided. The spacer serves as a bearing for a right roller closure cap 174 that is generally cylindrical in nature with a plurality of radially projecting ribs 176 for gripping the interior of the roller 84 to be described in more detail hereafter. The outer end of the right roller closure cap defines an enlarged rim 178 adapted to contact an inner face of the drive wheel 138 in a slidable relationship so that the drive wheel can be rotated independently of the right roller closure cap.

In assemblage, the mounting plate 118 is first positioned on the stub shaft 116 of the right end cap 104 and the coil springs 132 are placed on the support shaft 122 of the mounting plate. Next, the drive wheel 138 is positioned over the coil springs so that the tangs 136 of the springs are received in one of the slots 150 defined in the bifurcated shaft 146 of the drive wheel. Next the spacer 154 is positioned over the bifurcated shaft and the fastener 168 is inserted into the passage through the spacer so as to also extend through the drive wheel and subsequently into the hollow interior of the stub shaft where it is threadedly received so that the components of the clutch system 72 are assembled on the right end cap 104. Thereafter, the right roller closure cap 174 can be rotatably seated on the spacer.

After the clutch components are assembled and mounted on the right end cap, the coupler 160 can be seated in the open inner end of the spacer 154. The coupler has an enlarged cavity in its outer end for receipt of the head 170 of the fastener 168, and as mentioned previously the disk-like end with the slots 162 which receive the tabs 158 in the inner end of the spacer so that the coupler 160 rotates with the spacer.

The previously mentioned square drive shaft 74, which could be any shaft of non-circular cross section, has its right end seated and mated in the coupler 160 and extends horizontally through the head rail 58 and terminates near the left end of the head rail in the roller lift system 78 to be described later. In its passage through the head rail, however, it supports various components of the spool lift system 76. It will also be appreciated since the square shaft is mated with the coupler and the coupler turns with the spacer 154 and the drive wheel 138, the drive wheel also rotates the drive shaft about its longitudinal axis.

Figure 40A:
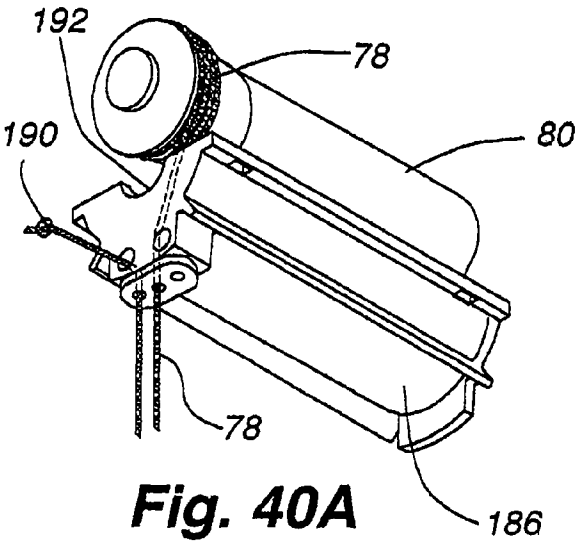
FIG. 40A is an isometric similar to FIG. 40 showing the lower half of the housing right side up and adjacent to a wrap spool.
Figure 40:
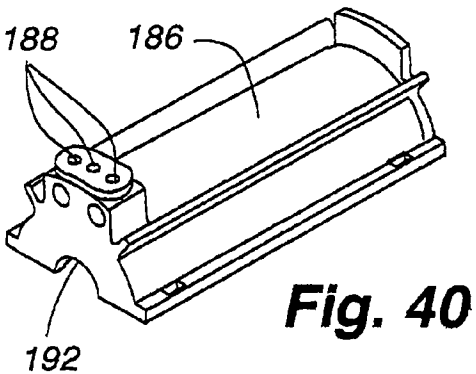
FIG. 40 is an inverted isometric of the lower half of the housing for the lift spool associated with the middle rail.

The spool lift system 76 is shown in FIG. 16B and 16C and includes a pair of lift spool assemblages 177 with each being associated with a spool lift cord 79 associated with the middle rail 60. The lift cord assemblages are identical even though mounted in mirror image to each other. The assemblages include a lift spool 80 having a square passage therethrough for mating receipt of the drive shaft 74, a cylindrical outer surface 179 and a frustoconical outer end surface 180. A longitudinal slot 182 is provided in the cylindrical surface along the length of the spool so that an upper knotted end of a spool lift cord 79 associated with the spool can be slidably received in the slot to anchor the upper end of the spool lift cord whose lower end is anchored to the middle rail 60 in a manner to be described hereafter. The spool 80 is rotatably seated within a two-part housing having upper 184 and lower 186 housing components or segments with the components defining a cylindrical space therein for surrounding the spool in close relationship thereto. Preferably, the inner surface of the housing components are only spaced from the cylindrical surface 178 of the spool a distance slightly greater than the thickness of a spool lift cord so that only a single layer of lift cord will wrap on the spool to avoid entanglement. The lift spool could be of the type disclosed in detail in U.S. patent application Ser. No. 10/874,490 filed Jun. 22, 2004, now U.S. Pat. No. 7,159,635 issued on Jan. 9, 2007, which is incorporated herein by reference. The lower housing component 186, shown in FIGS. 16B and 16C and also in more detail in FIG. 40, has three holes 188 extending through the bottom component of the housing with one hole slidably receiving the spool lift cord 79 anchored to the associated spool 80 and therebeneath to the middle rail 60 and another of the three holes serving to anchor the top end 190 (FIG. 40A) of a roller lift cord associated with the bottom rail 62. The top end of the roller lift cord associated with the bottom rail is knotted above the holes 188, but within the interior of the lower housing component to be fixed in position with the housing for the lift spool. The housing components also have notches 192 formed in end walls thereof which serve as bearing surfaces for the spools 80 so the spools are free to rotate within the assembled housings by rotation of the square drive shaft 74 which also extends through the notches in the ends of the housing components.

As an alternative to anchoring the top end 190 of a roller lift cord 82 to the lower spool housing component 186, an anchor plate 193 can be positioned in the roller 84 (FIG. 16C) overlying a hole 195 in the roller with the anchor plate having a passage 197 through which the lift cord extends so the cord can be knotted to support the top end 190 on the anchor plate. This system of anchoring a roller lift cord to the roller also enables roller lift cords to be attached to the roller at locations where a spool assemblage 177 is not present.

The right lift spool assemblage 177 shown in FIG. 16B is positioned immediately inwardly of the coupler 160 while the left lift spool assemblage shown in FIG. 16C is mounted to the left of a limiting system 194 associated with the spool lift system 76.

The limiting system 194 includes an elongated square shaft 196 that is threaded on its outer surface and includes a square passage therethrough for mating receipt of the drive shaft 74 so the square externally threaded shaft rotates in unison with the drive shaft 74. An internally threaded spool follower 198 is threadedly mounted on the exterior of the square threaded shaft and includes diametrically opposed tabs 200 that are adapted to be received in internal channels 202 defined in upper 204 and lower 206 segments of the roller 84. The roller has two segments to facilitate assembly of the operative parts of the system 50 within the roller before the roller segments are releasably snapped together. The two segments are clipped together with a clip 207 (FIG. 16B), which operates with grooves 209 formed in the outer surface of the segments 204 and 206. The tabs 200 are slidably connected to the roller so the follower rotates with the roller and relative to the threaded square shaft 196 so as to be capable of translating linearly relative to the square threaded shaft. As will be appreciated, if the roller 84 is being rotated relative to the square threaded shaft or vice versa, in a manner to be described hereafter, the spool follower 198 will translate along the length of the square threaded shaft 196 due to the internal threads of the spool follower engaging the external threads on the square threaded shaft. The translating or longitudinal movement of the spool follower is limited by a left 208 and right 210 abutment collar having opposed flexible tabs 212 projecting into a square passage through the collars with the tabs being adapted to snap along the threaded outer surface of the square threaded shaft as the collar is linearly forcefully advanced along the length of the square shaft, but will retain the collar in a pre-selected position along the length of the externally threaded square threaded shaft once desirably positioned. The spacing between the abutment collars will limit the translative movement of the spool follower as will be described hereafter. The spool follower will engage one abutment collar when being translated in one direction along the square threaded shaft and the other abutment collar when being translated in the opposite direction along the square threaded shaft for a purpose to be described hereafter with the operation of the system. Both the follower 198 and the abutment collars include engaging and confronting lips 213 which grab each other at the end of a translated movement of the follower to prevent jamming of the system.

Figure 16D:
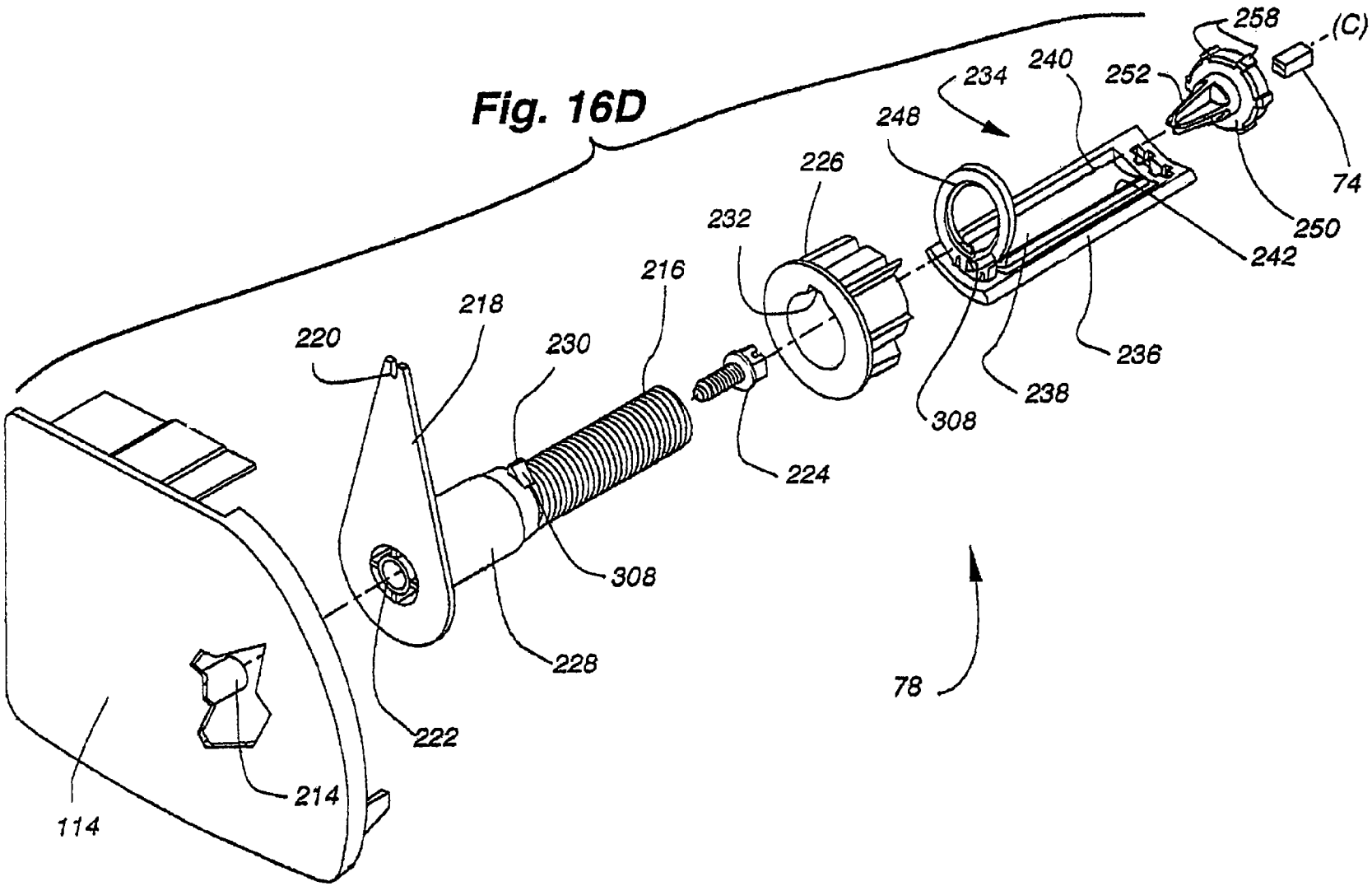
FIG. 16D is an exploded isometric of components of the head rail and controls immediately to the left of that shown in FIG. 16C.

The square drive shaft 74 as it extends to the left from the limiting system 194 passes through the left lift spool assemblage 177 and thereafter has its left end terminating in the roller lift system 78 shown in FIG. 16D. The roller lift system is mounted on the left end cap 114, which is substantially a mirror image of the right end cap 104. It too, therefore, has a stub shaft 214 with an axial opening therein. A threaded shaft 216 forming part of the roller lift system 78 is secured to the left end cap of the head rail 58 so as to be fixed relative thereto. The threaded shaft 216 has a plate-like outer end 218 that abuts the inner face of the left end cap with the plate having a notch 220 formed in the top edge thereof for receipt of a tab (not seen) but which is identical to the tab 126 found on the right end cap. The stub shaft is hollow therethrough and has a cylindrical bearing surface 222 formed internally for receipt on the stub shaft so that the threaded shaft 216 can be mounted on the stub shaft with the notch 220 in the end plate 218 received on the tab to prevent relative movement between the threaded shaft and the left end cap. A fastener 224 is inserted through the hollow interior of the threaded shaft 216 and received in the hole in the stub shaft 214 to secure the threaded shaft to the left end cap. A left end roller closer cap 226 is rotatably seated on a non-threaded cylindrical portion 228 of the threaded shaft and a stop tab 230 formed on the threaded shaft at the outer end of the thread, for a purpose to be defined hereafter, passes through a notch 232 formed in the left end roller closure cap 226 to permit the roller closure cap to be advanced across the threaded portion of the shaft and onto the non-threaded cylindrical portion 228 during assembly. Accordingly, once the left roller closure cap is mounted on the cylindrical non-threaded bearing portion, it is free to rotate thereabout.

Figure 36:
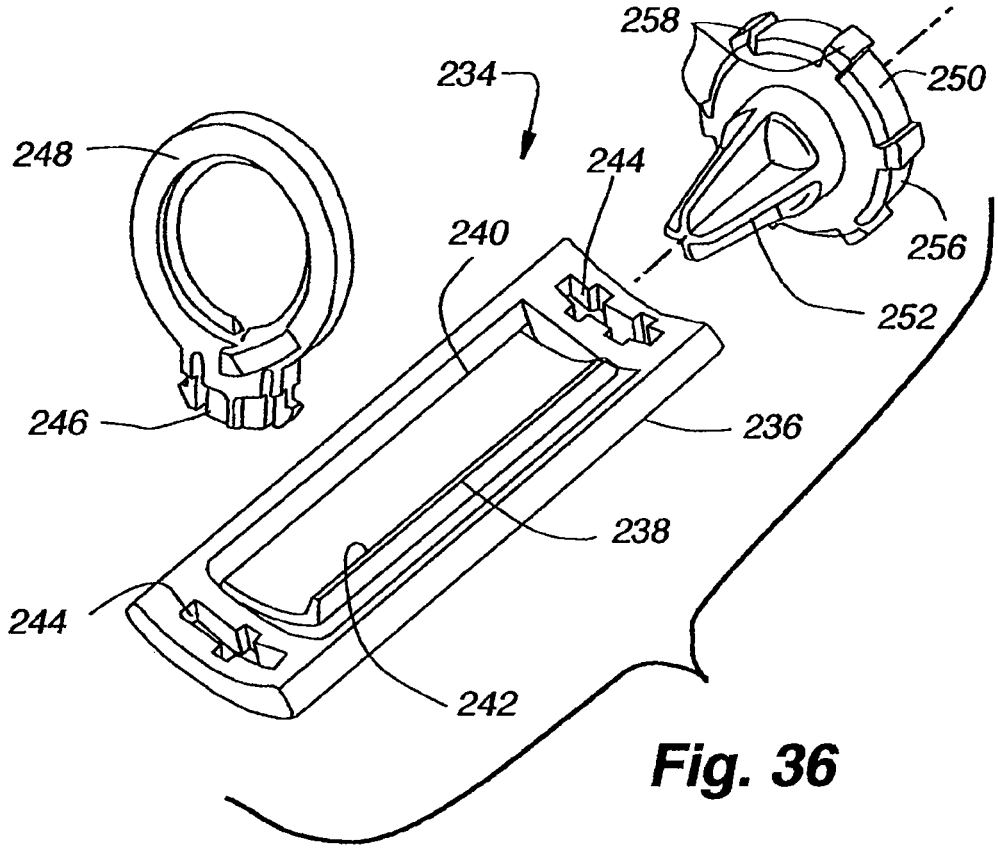
FIG. 36 is an exploded isometric showing the follower slide plate used at the left end of the head rail.
Figure 37:
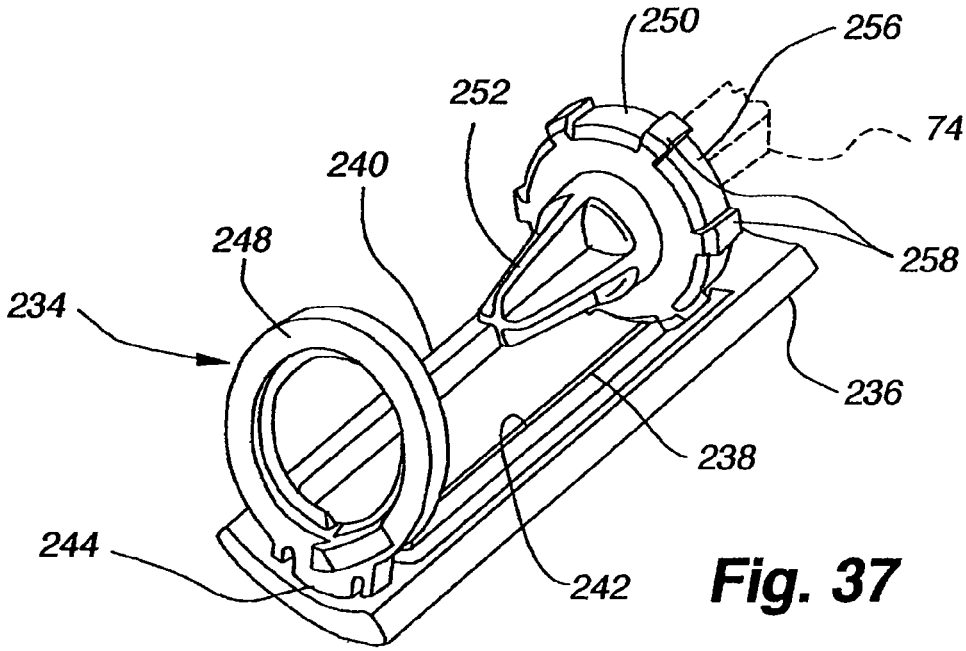
FIG. 37 is an assembled isometric of the components shown in FIG. 36.
Figure 38:
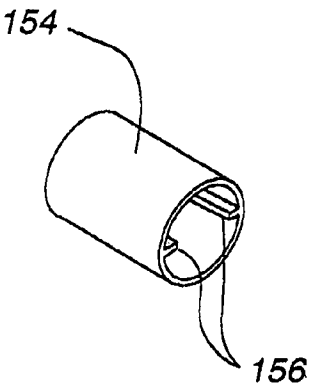
FIG. 38 is an isometric of the anchor used for attaching the coupler to the roller.
Figure 39:
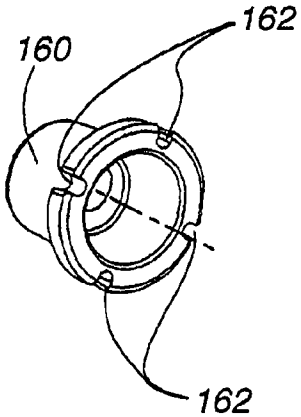
FIG. 39 is an isometric of the coupler used for coupling the square cross-section drive shaft with the roller for the shade material.

A two-piece follower 234, seen in FIG. 16D and shown in more detail in FIG. 36, has an elongated arcuate base plate 236 with a longitudinally extending flex finger 238 integrally connected to an outer perimeter of the base plate along one longitudinal edge 240 and having an opposite free edge with a radially inwardly directed lip 242. The flex finger is adapted to flex slightly about its connected edge to the base plate for a purpose to be described hereafter. Each end of the base plate has a slot 244 for retention and receipt of a leg 246 of a circular internally threaded follower ring 248 so the follower ring can be connected to one end of the base plate while projecting radially inwardly from the arcuate base plate. The follower ring is adapted to be threadedly received on the threaded portion of the threaded shaft 216 so rotation of the two-piece follower relative to the shaft 216 will cause the two-piece follower to translate longitudinally of the threaded shaft. With the two-piece follower threadedly mounted on the threaded shaft, a cogwheel 250 having a tapered stub shaft 252 is rotatably inserted into the inner open end of the threaded shaft 216 with the cogwheel having a square hole 254 on the opposite face from the tapered stub shaft to matingly receive the left end of the square drive shaft 74. The cogwheel is therefore adapted to rotate with the drive shaft and relative to the threaded shaft 216. The cogwheel has a disk-like body 256 with a plurality of circumferentially spaced radially outwardly extending dogs 258 having outer ends which are radially spaced a pre-determined distance from the base plate 236 of the two-piece follower. As will be appreciated with the description of the operation of the system that follows, rotation of the cogwheel in one direction, i.e., a counter-clockwise direction as viewed in FIG. 16D, allow the dogs to engage but depress the flex finger 238 as the dogs snap thereby but rotation of the cogwheel in the opposite or clockwise direction as viewed in FIG. 16D would allow the dogs to engage the lip 242 on the flex finger and force the flex finger and two-piece follower to rotate in unison with the cogwheel and in doing so causes the two-piece follower to translate linearly, while being guided within an internal channel 202 in one direction along the threaded shaft 216. The length of the head rail 58 is known for a given installation of the covering 52 and accordingly, the length of the square drive shaft 74 is cut to fit within the spacing between the cogwheel 250 and the coupler 160 at the opposite end of the head rail.

Figure 41:
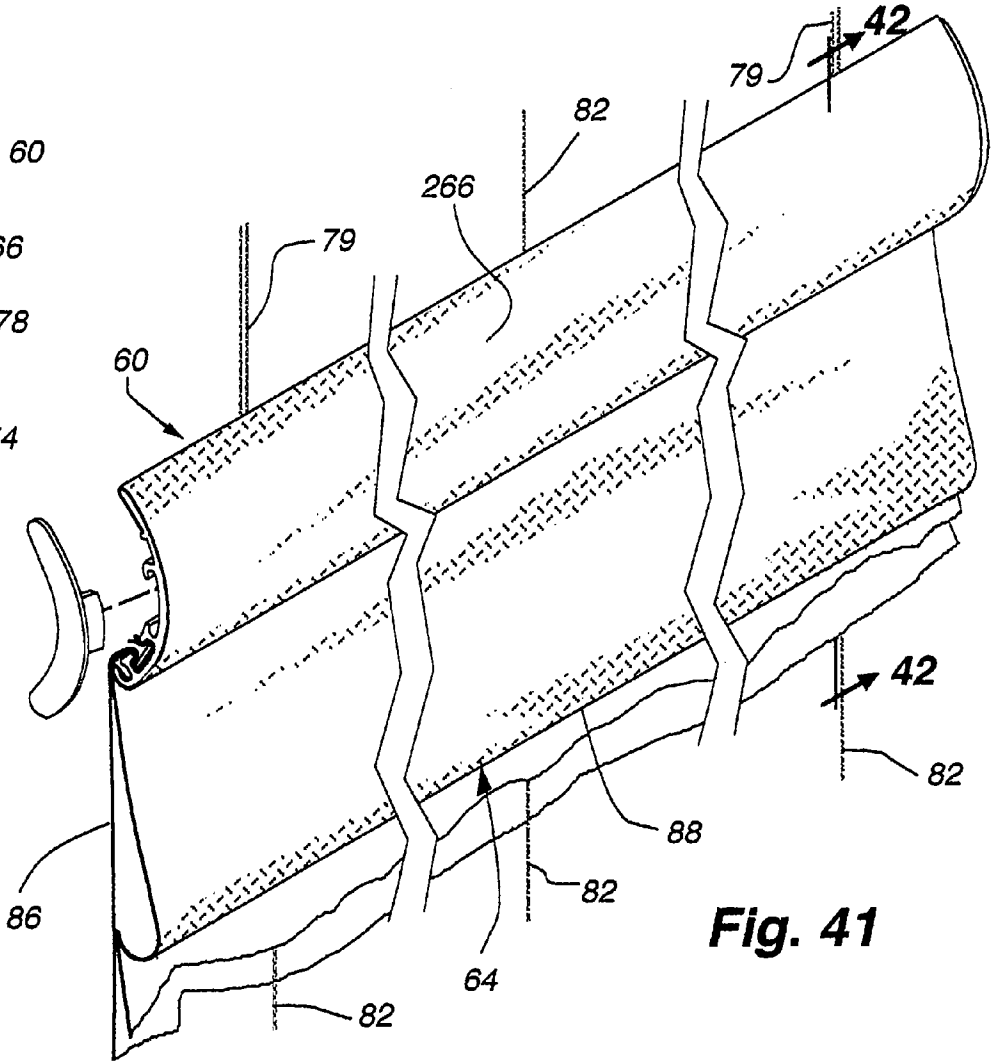
FIG. 41 is a fragmentary isometric showing the middle rail in a partially lowered position and with the shade material depending therefrom.
Figure 42:
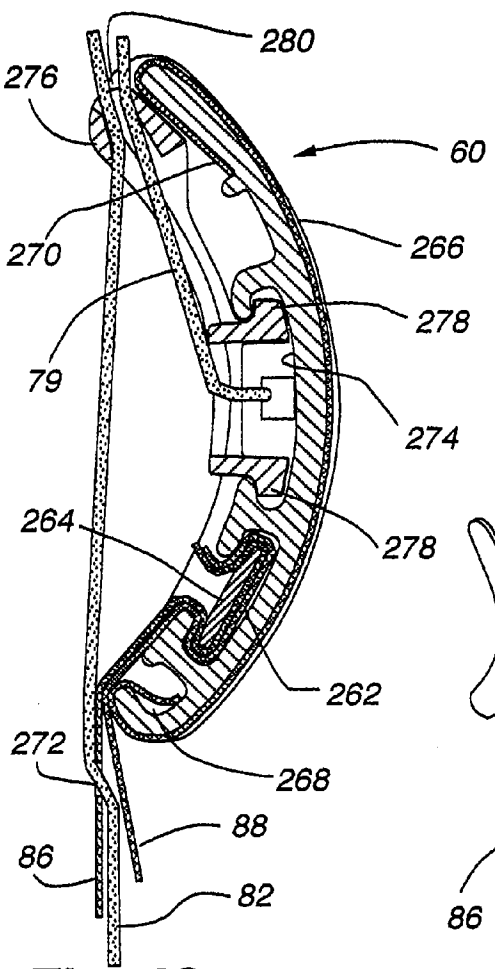
FIG. 42 is an enlarged section along line 42-42 of FIG. 41.
Figure 43:
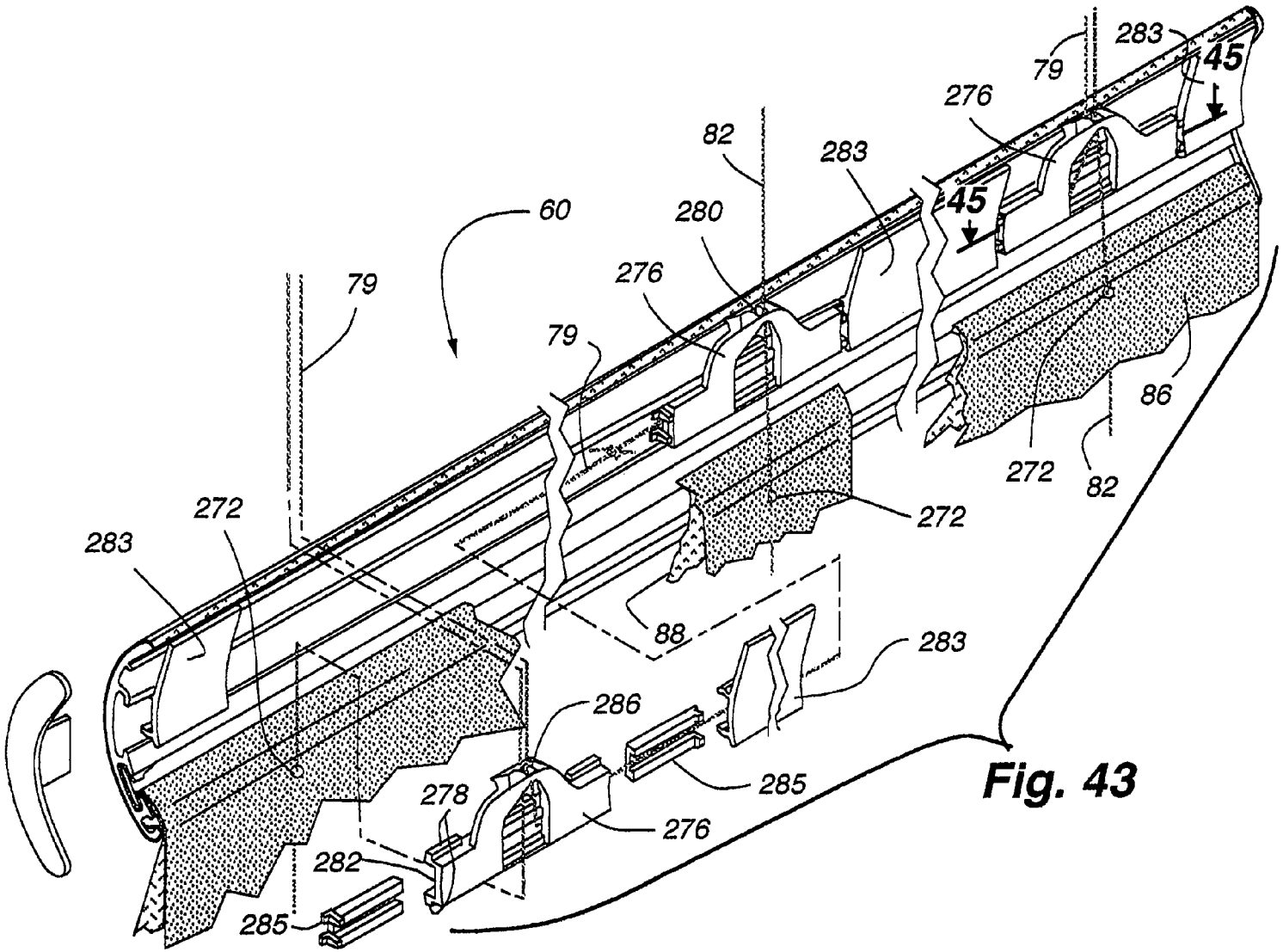
FIG. 43 is a fragmentary isometric of the middle rail.
Figure 45:
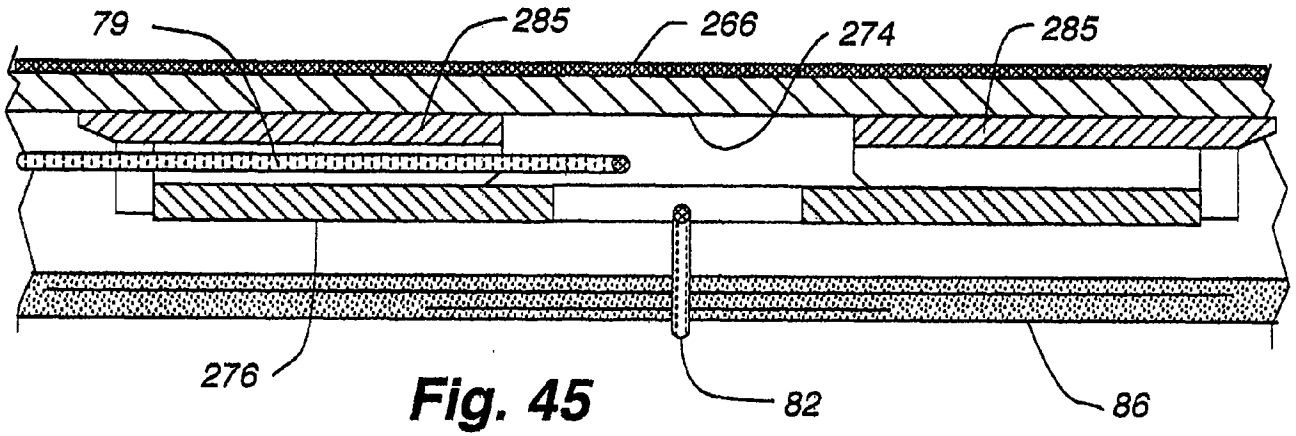
FIG. 45 is an enlarged fragmentary section taken along line 45-45 of FIG. 43 with the cords having been removed.
Figure 44:
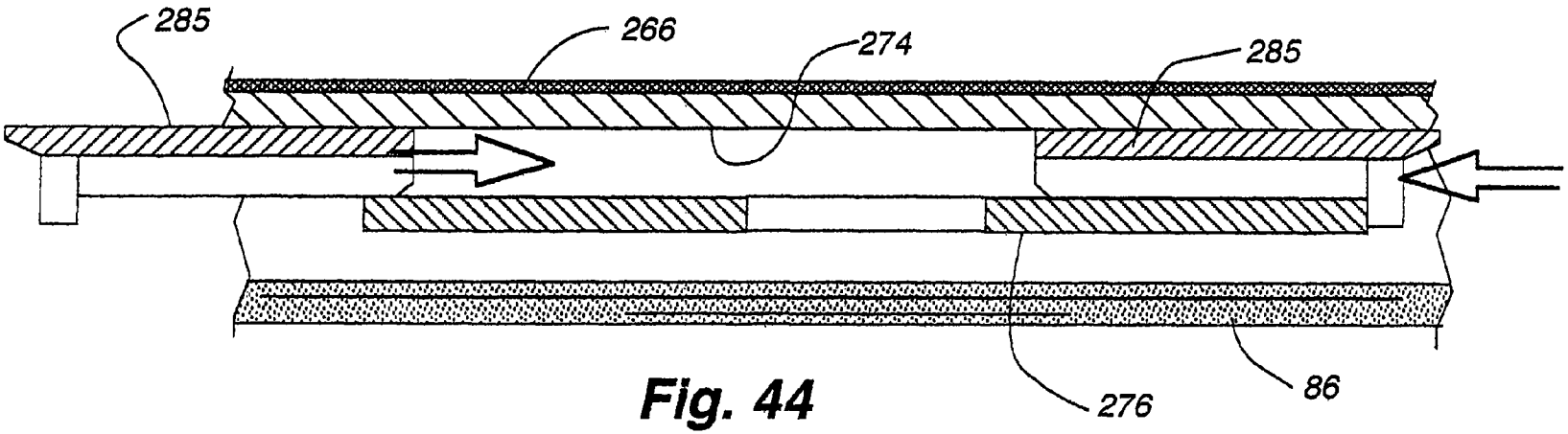
FIG. 44 is a section similar to FIG. 45 with the cords included.

With reference to FIGS. 41-43, the middle rail 60 is illustrated along with its operative connection to other parts of the covering. The middle rail can be seen to be an extruded strip of aluminum, plastic, or the like, and generally of arcuate cross-section having three longitudinally extending grooves defined in the lower half thereof in a rear concave surface of the rail. The grooves are each of generally C-shaped cross-section so as to confine other elements to the middle rail as will be described hereafter.

As mentioned previously, the flexible sheet 64 of material that extends between the middle rail and the bottom rail in the disclosed embodiment has a front sheet 88 and a rear sheet 86. With reference to FIGS. 41 and 42, the rear sheet can be seen to be anchored with the front sheet in an intermediate groove 262 in the rear of the middle rail with a retention bar 264 that is confined within the generally C-shaped cross-section of the groove. Both the front and rear sheets then depend downwardly from the bottom edge of the middle rail.

A decorate facing 266 for the middle rail, which may be for example the same material as the front sheet, has its lower edge anchored as with adhesive or the like in the lowermost groove 268 on the back of the middle rail and its upper end 270, after having been stretched across the convex front face of the middle rail, adhesively secured to the rear concave face of the middle rail. In this manner, there is continuity between the front visible finish of the middle rail and the front sheet of material that depends therefrom.

The roller lift cords 82 and the spool lift cords 79 slidably pass across the top edge of the middle rail. The roller lift cords slide freely across the rear side of the middle rail and then extend through a hole 272 formed in the rear sheet 86 so the cord thereafter drops between the front 88 and rear sheets. At locations where the front and rear sheets are secured together with adhesive, gaps in the adhesive can be provided through which the roller lift cord can slidably pass in its passage downwardly for its connection to the bottom rail 62.

The uppermost groove 274 in the rear of the middle rail is adapted to slidably receive lift cord slide brackets 276 with these brackets having opposed fingers 278 for slidable confinement within the groove. Each lift cord slide bracket has a centered passage 280 through the top edge thereof for guidance of the roller lift cord 82 and the spool lift cords 79 with the spool lift cords then passing laterally through a horizontal passage 282 in the slide bracket where it can be tied, as seen in FIG. 43, to a spool lift cord from an adjacent slide bracket so the spool lift cords are all tied in a continuous loop. Between brackets 276, cover plates 283 are anchored in the uppermost groove 274 to overlie and confine the interconnected spool lift cords for safety purposes. The connection of the spool lift cords in this manner serves as a self-leveling system inasmuch as the cords slidably pass through the bracket so that, should the middle rail become askew or tilted, it will self-align during operation of the covering. In order to secure the brackets in position along the length of the middle rail and in alignment with the spool and roller lift cords associated with the middle rail and bottom rail, removable wedges are provided to frictionally hold the bracket in place relative to the middle rail extrusion.

Figures 46, 47:
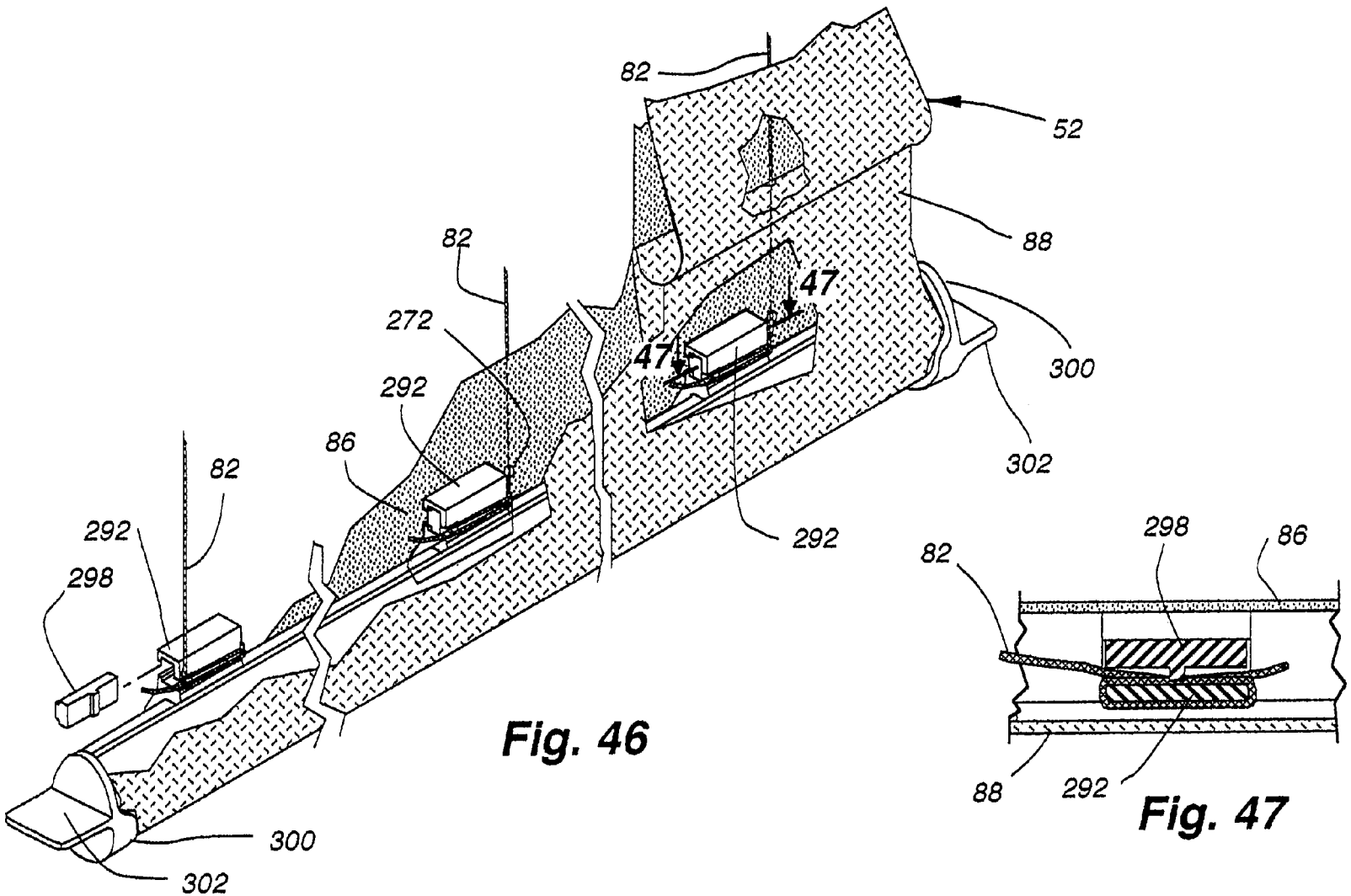
FIG. 46 is a fragmentary isometric showing the bottom rail with the shade material attached thereto.
FIG. 47 is an enlarged fragmentary section taken along line 47-47 of FIG. 46.
Figure 48:
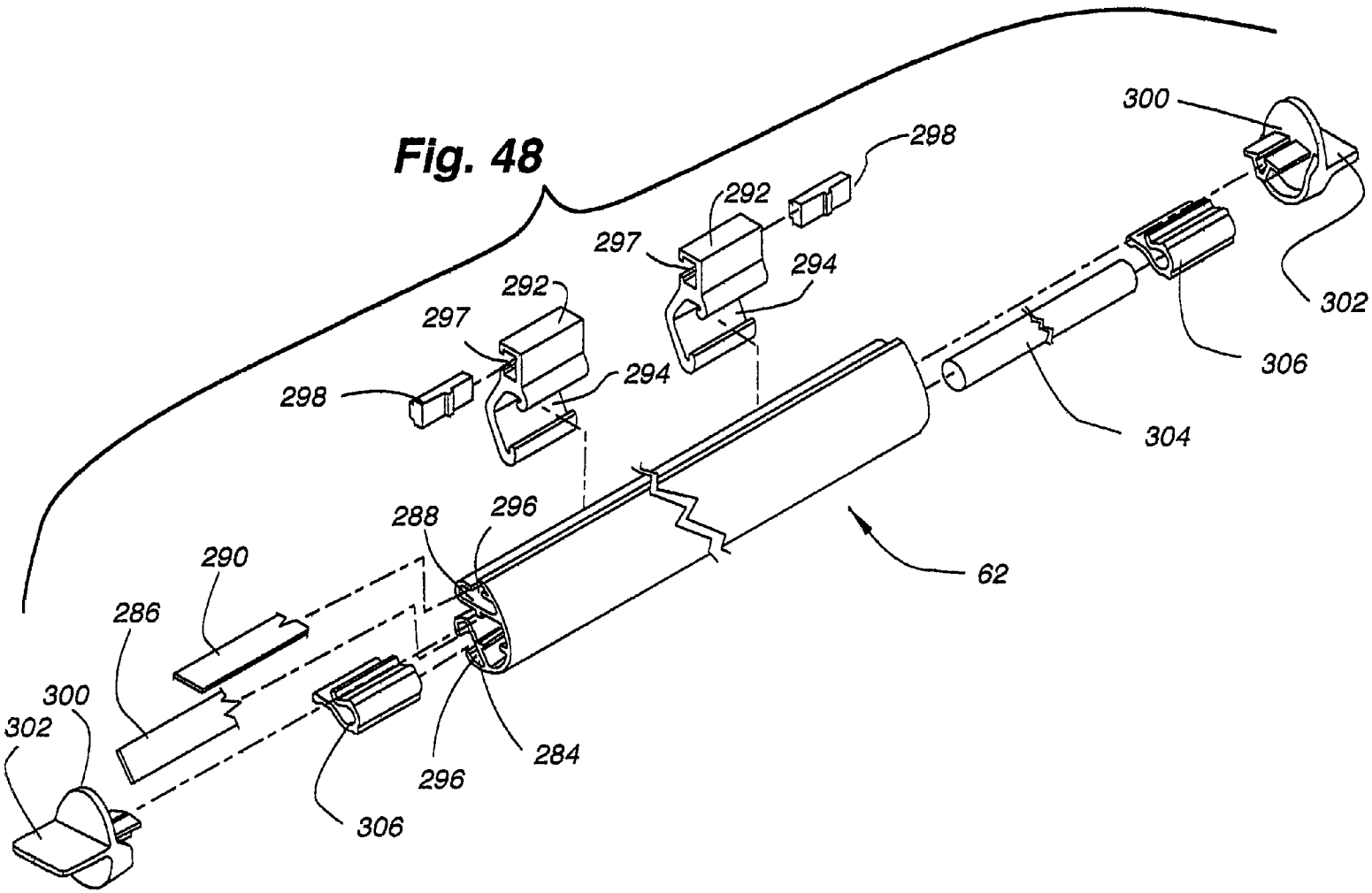
FIG. 48 is an exploded isometric of the bottom rail.

Looking at FIGS. 46-48, the bottom rail 62 is illustrated along with its operative relationship with the covering 52 and it too can be seen in FIG. 48 to be an elongated extruded strip of material such as aluminum, plastic or the like having various grooves formed in the back and top surfaces thereof. The front of the bottom rail is arcuate so that the front sheet of material 88 can be wrapped around the arcuate front of the bottom rail with the bottom edge of the front sheet being secured in a channel 284 formed along the rear bottom edge of the bottom rail with an anchor bar 286 as with the securement of the sheet to the middle rail. Similarly, the rear sheet 86 is anchored in a channel 288 in the top of the bottom rail, again with an anchor bar 290 as with the middle rail.

Anchor brackets 292 having a forwardly opening channel 294 for cooperation with channels 296 in the back of the bottom rail 62 are provided so they can be desirably positioned along the length of the bottom rail and in alignment with the roller lift cords 82 associated with the bottom rail. These brackets also have rearwardly facing channels for receipt of an anchor finger 298 so the bottom end of an associated roller lift cord can be inserted into the channel and frictionally retained therein by inserting the anchor finger into the channel as possibly seen best in FIGS. 46 and 47. End caps 300 for the bottom rail are provided with horizontally disposed abutment tabs 302 which are adapted to cooperate with the head rail in terminating upward movement of the bottom rail during operation of the covering as will be appreciated with the description that follows. With reference to FIG. 48, a commonly used ballast system for leveling the bottom rail is also incorporated into the bottom rail with the ballast including a relatively heavy cylindrical rod 304 which is slidably disposed in one of the channels in the rear of the bottom rail and retained therein with friction stops 306 disposed in the channel at opposite ends of the cylindrical rod. By moving the cylindrical rod longitudinally of the bottom rail, the weight distribution of the bottom rail can be adjusted to correct any minor misalignments as is well known in the trade.

Operation of the control system for the covering of the present invention is probably best appreciated by reference to FIGS. 31-35 but before specifically describing the operation, it is assumed the covering is in a fully retracted position with both the middle rail 60 and the bottom rail 62 positioned closely adjacent to the head rail 58 and the sheet material 64 being gathered between the middle rail and the bottom rail as shown in FIG. 1. As mentioned previously, in the descriptions of the spool lift system 76 and the roller lift system 78, each system includes a follower and as will be appreciated with the description of the operation hereafter, those followers move from one extreme position to the right (FIGS. 31A), when the middle and bottom rails are fully raised or retracted and a second extreme position to the left (FIGS. 31 and 32) when both the middle and bottom rails are fully extended or at their lowermost position.

Assuming the covering is in the fully retracted position with both the bottom 62 and middle 60 rails fully elevated adjacent to the head rail 58 as shown in FIG. 1, rotation of the control element 56 in a clockwise direction as seen in the sectional views of 33-35 will rotate the drive wheel 138 in a clockwise direction which also rotates the square drive shaft 74 in a clockwise direction. As the square drive shaft rotates in a clockwise direction, so does the cogwheel 250 so one of the dogs 258 on the cogwheel will engage the upstanding lip 242 of the flex finger 238 and force the flex finger to follow the cogwheel thereby causing the two-piece follower to rotate. Since the two-piece follower is slidably positioned within the interior of the roller 84, but fixed circumferentially relative to the roller, the clockwise rotation of the cogwheel will force the roller to rotate in a clockwise direction with the two-piece follower. As the roller is rotating in a clockwise direction, the flexible sheet material 64 wrapped therearound will unwrap allowing the bottom rail 62 to lower or extend along with its associated roller lift cords 82. As the two-piece follower rotates, it is rotating relative to the threaded shaft 216 which as mentioned previously is fixed to the left end cap 114 of the head rail 58 so the two-piece follower translates outwardly or toward the left end cap due to the threaded relationship between the follower ring 248 and the threaded shaft. When the ring gets to the end of the threaded portion of the threaded shaft, it engages the stop tab 230 and due to a pair of interlocking ramps 308 on the ring follower and the threaded shaft, further translation of the two-piece follower is terminated. At this position of the two-piece follower, the flex finger 238 has translated to the left beyond the cogwheel so the cogwheel no longer engages the lip 242 on the flex finger. Accordingly, continued rotation of the cogwheel with the drive wheel 138 in a clockwise direction allows the cogwheel to continue to rotate, but the two-piece follower no longer rotates and the roller 84 itself consequently no longer rotates. This occurs when the bottom rail 62 has reached its lowermost or fully extended position adjacent to the bottom sill of the architectural opening (FIGS. 2 and 3).

When the roller 84 stops rotating, so does the lift spool follower as it is keyed to the roller via the diametrically opposed tabs on the lift spool follower 198. However, the square drive shaft 74 is still rotating, thereby rotating the square threaded shaft 196 which causes the lift spool follower to translate to the left from the position of FIG. 31A, where it is in engagement with the right abutment collar 210, until it reaches the position of FIG. 31 wherein it abuts the left abutment collar 208. As this movement of the follower occurs, it will be appreciated the lift spools 80 are rotating with the square drive shaft 74 and relative to the roller 84 so the spool lift cords 79 associated with the spools and the middle rail 60 are unwound from the spools allowing the middle rail to drop by gravity. This is illustrated by reference to FIG. 9. It should be appreciated the spool lift cords associated with the spools do not unwind during rotation of the roller 84 as the spools themselves are rotating with the roller due to the engagement of the lower spool housing 186 in an internal groove provided in the roller. Accordingly, as long as the roller itself is rotating, the spool lift cords associated with the spools do not wind onto or unwind from the spools but will only wind and unwind when the spools are being rotated and the roller is stationary.

Figure 3:
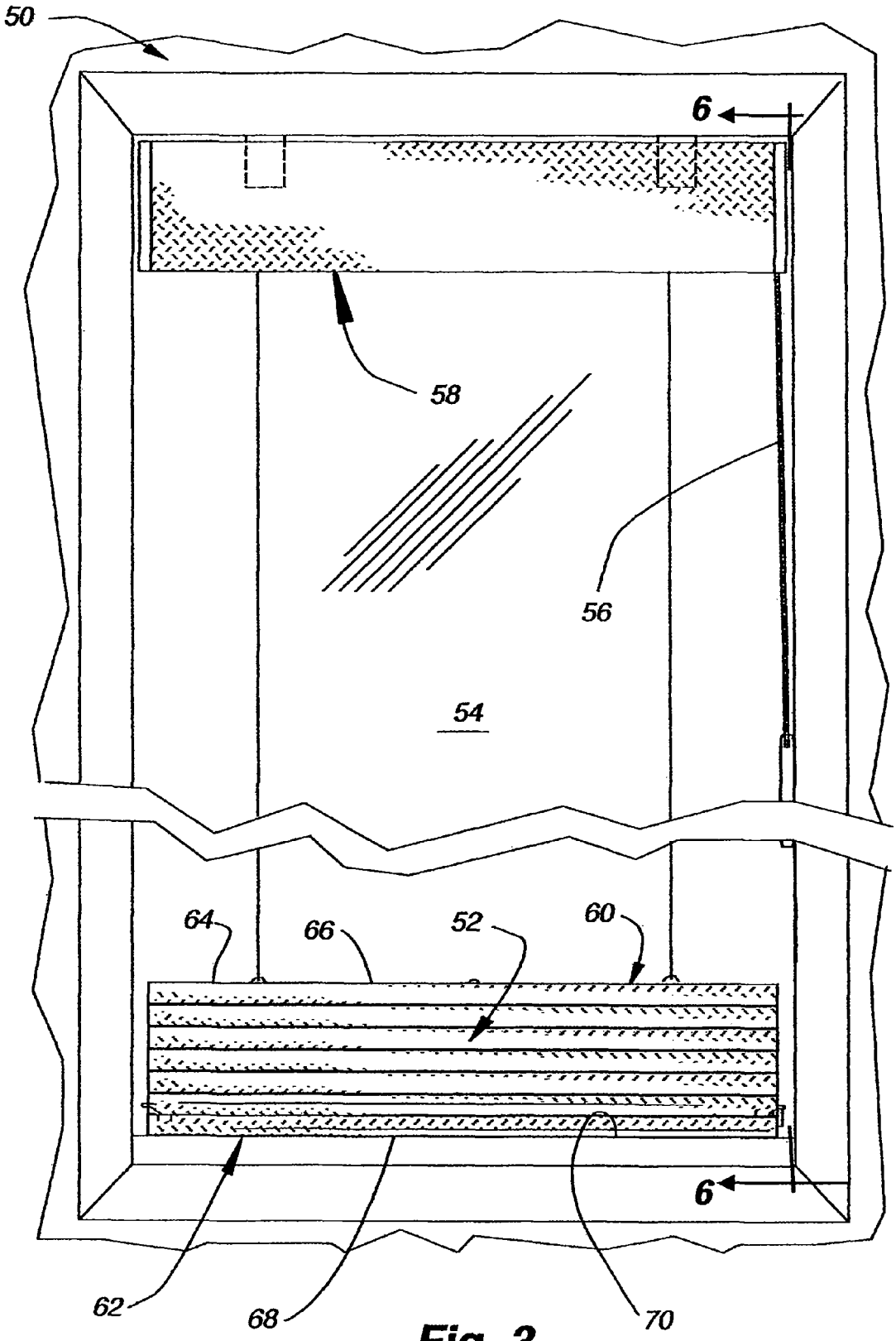
FIG. 3 is a front elevation similar to FIG. 2 wherein the middle rail has been substantially lowered.
Figure 4:
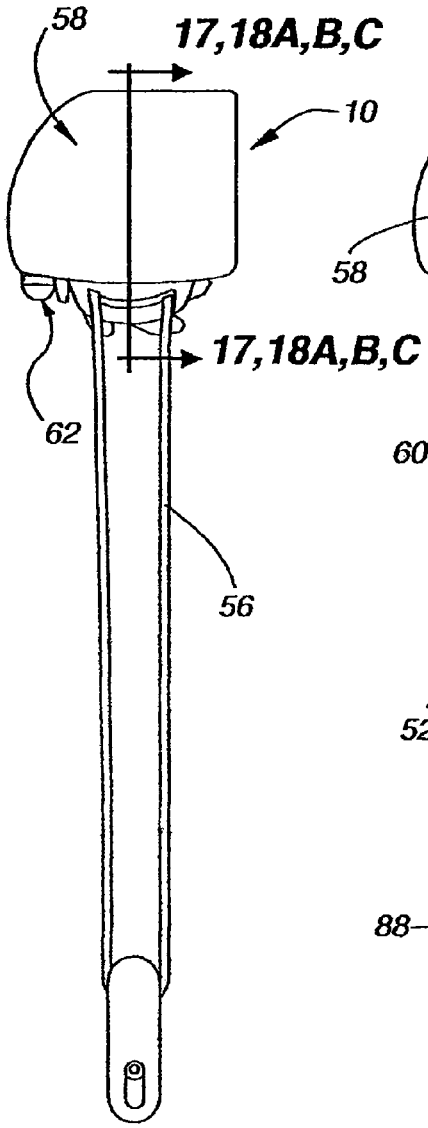
FIG. 4 is a section taken along line 4-4 of FIG. 1.
Figure 5:
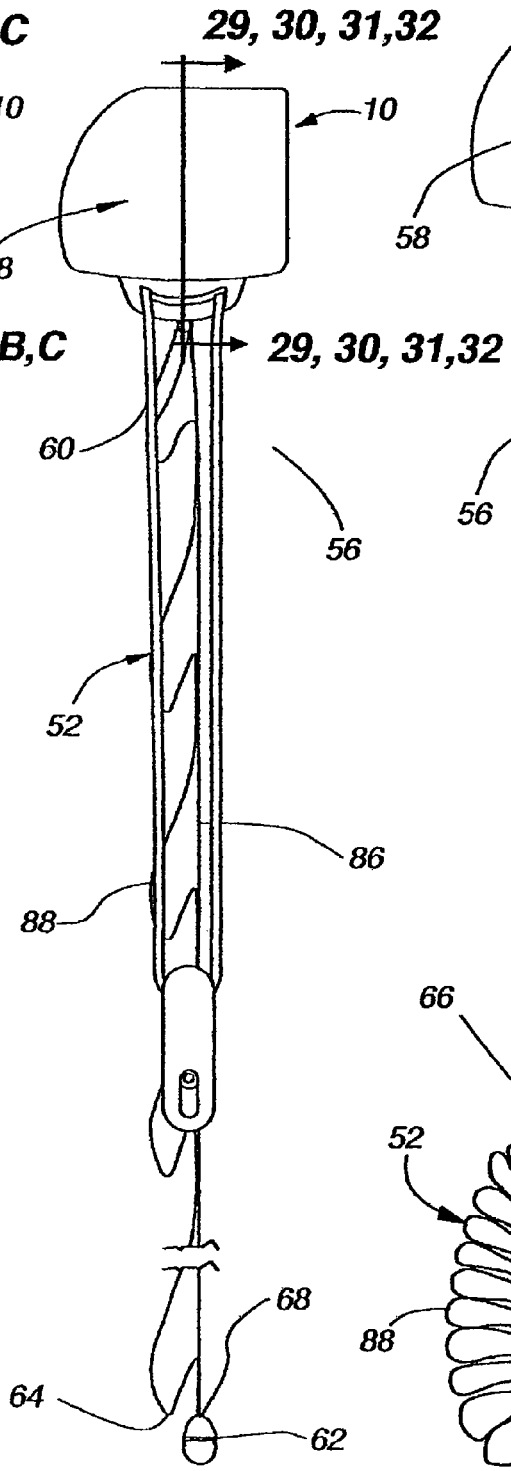
FIG. 5 is a section taken along line 5-5 of FIG. 2.
Figure 6:
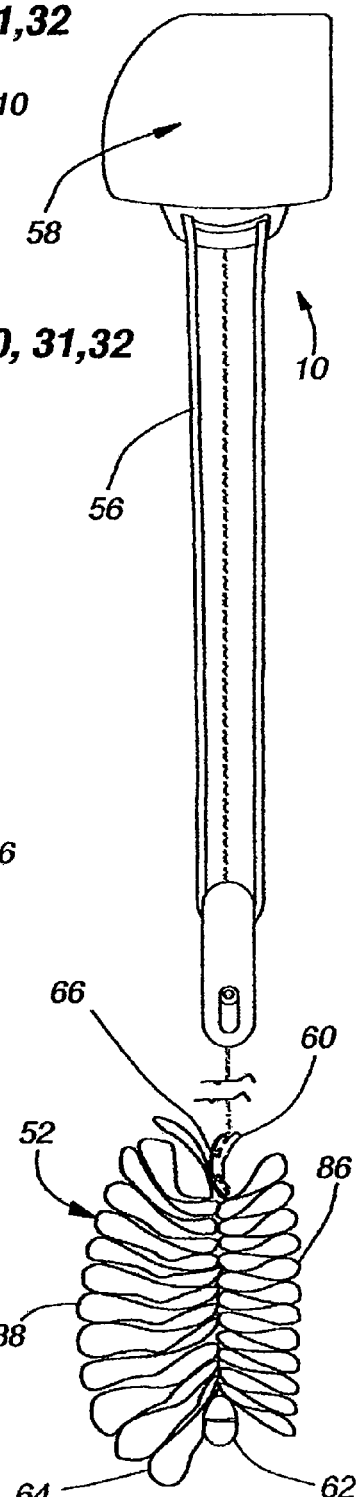
FIG. 6 is a section taken along line 6-6 of FIG. 3.
Figure 7:
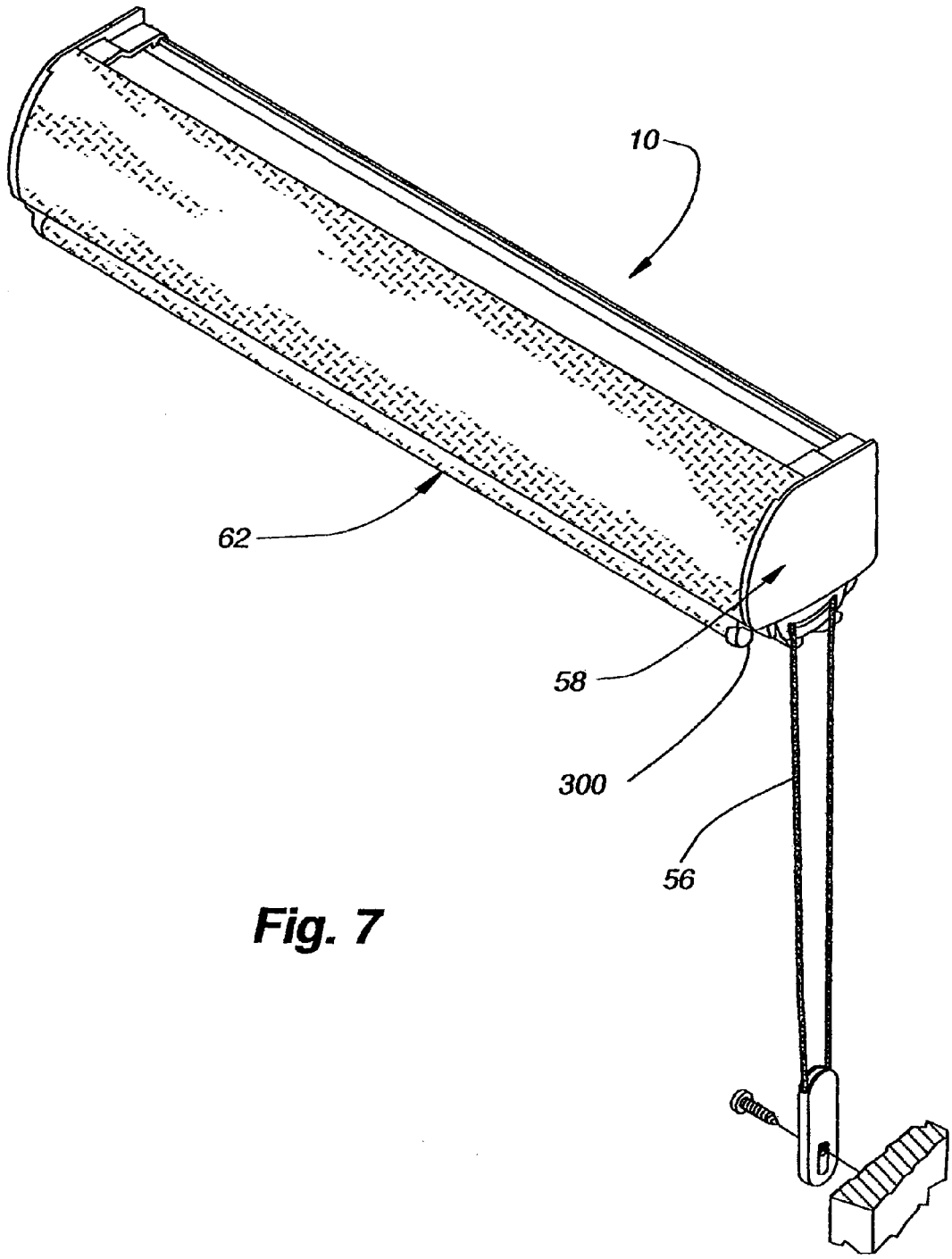
FIG. 7 is an isometric of the covering in its fully retracted position of FIG. 1.
Figure 8:
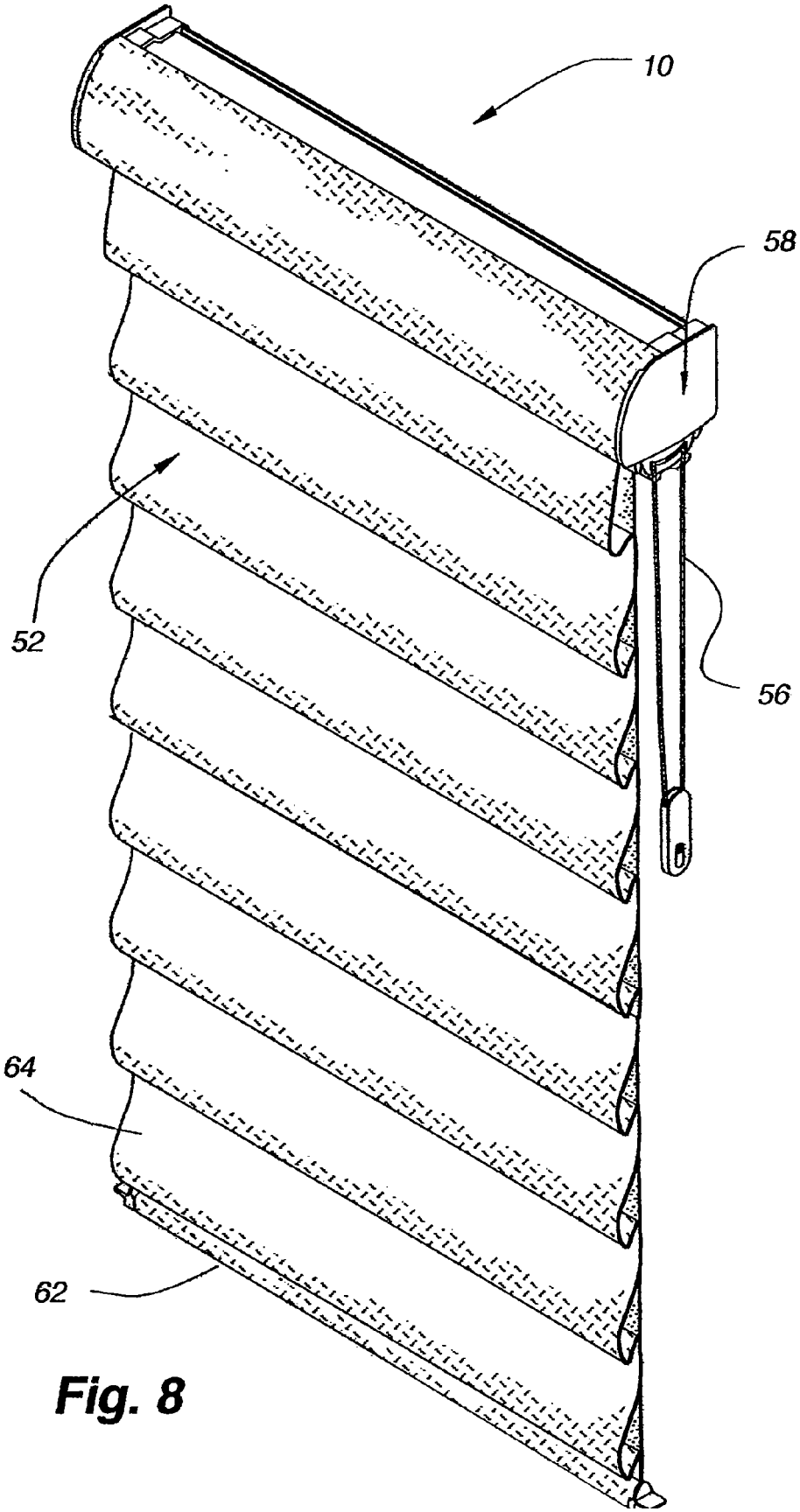
FIG. 8 is an isometric of the covering in the fully extended position of FIG. 2.
Figure 9:
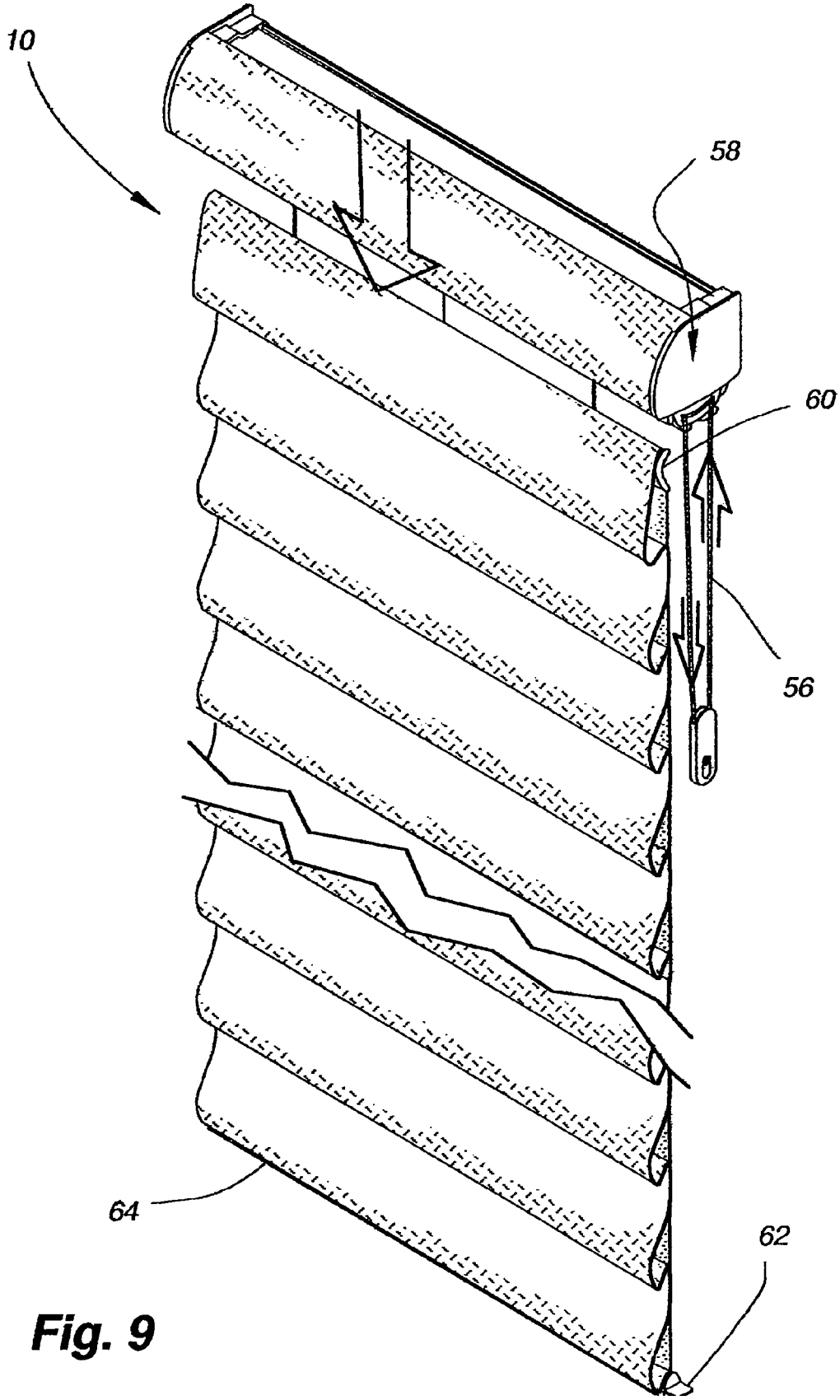
FIG. 9 is an isometric similar to FIG. 8 wherein the middle rail is lowered a small amount from its fully retracted position of FIG. 8.
Figure 10:
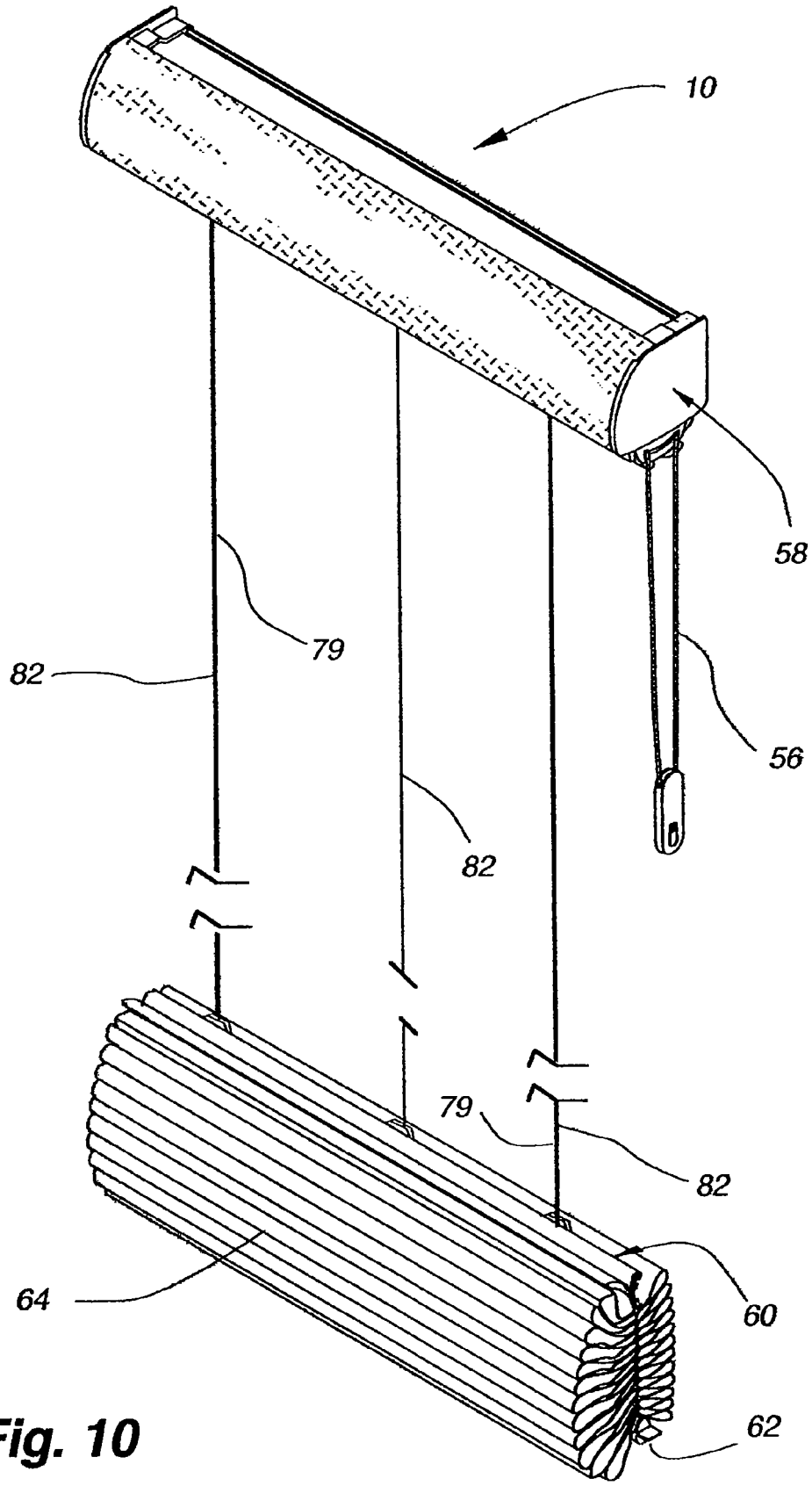
FIG. 10 is an isometric of the covering as shown in FIG. 3.
Figure 11:
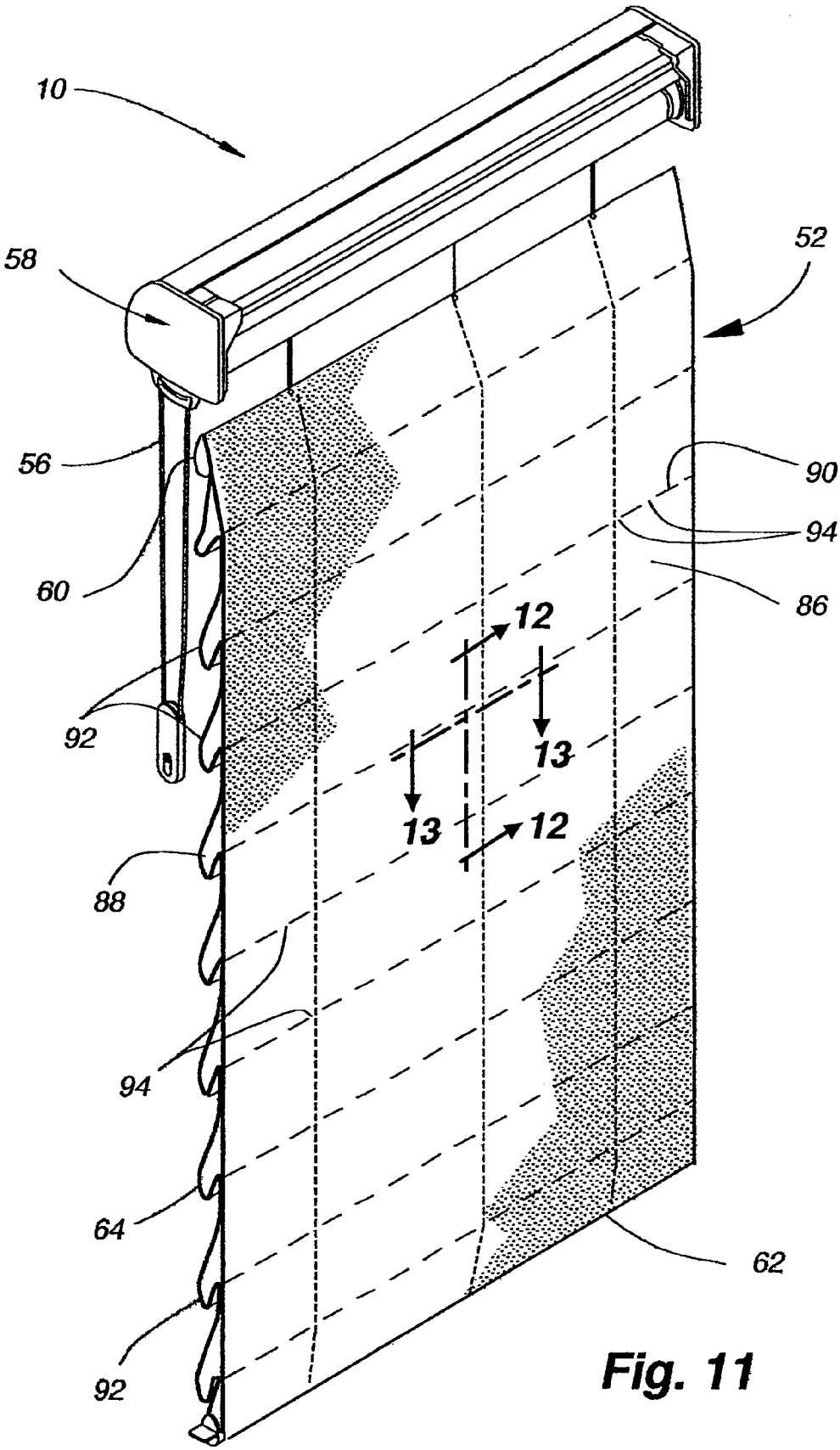
FIG. 11 is an isometric of the covering as shown in FIG. 9 except viewed from the rear of the covering.
Figure 12:
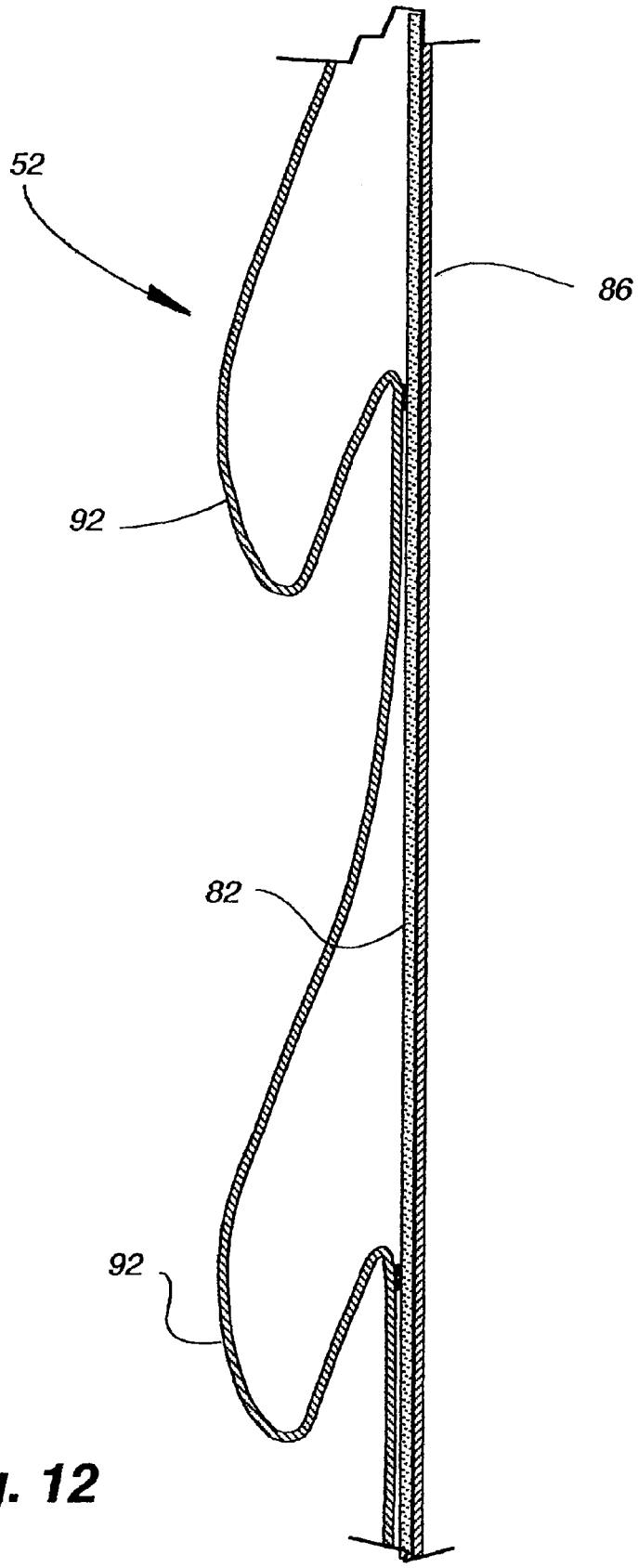
FIG. 12 is an enlarged section taken along line 12-12 of FIG. 11.

The spacing between the abutment collars 208 and 210 in the spool lift system 76 is regulated in accordance with the height of the covering or the length of the sheet material 64 so that as the follower traverses from the right abutment collar to the left abutment collar, the middle rail is lowered from its fully retracted position of FIG. 1 to its fully extended position of FIG. 3 adjacent to the bottom rail which was previously lowered.

Figure 33:
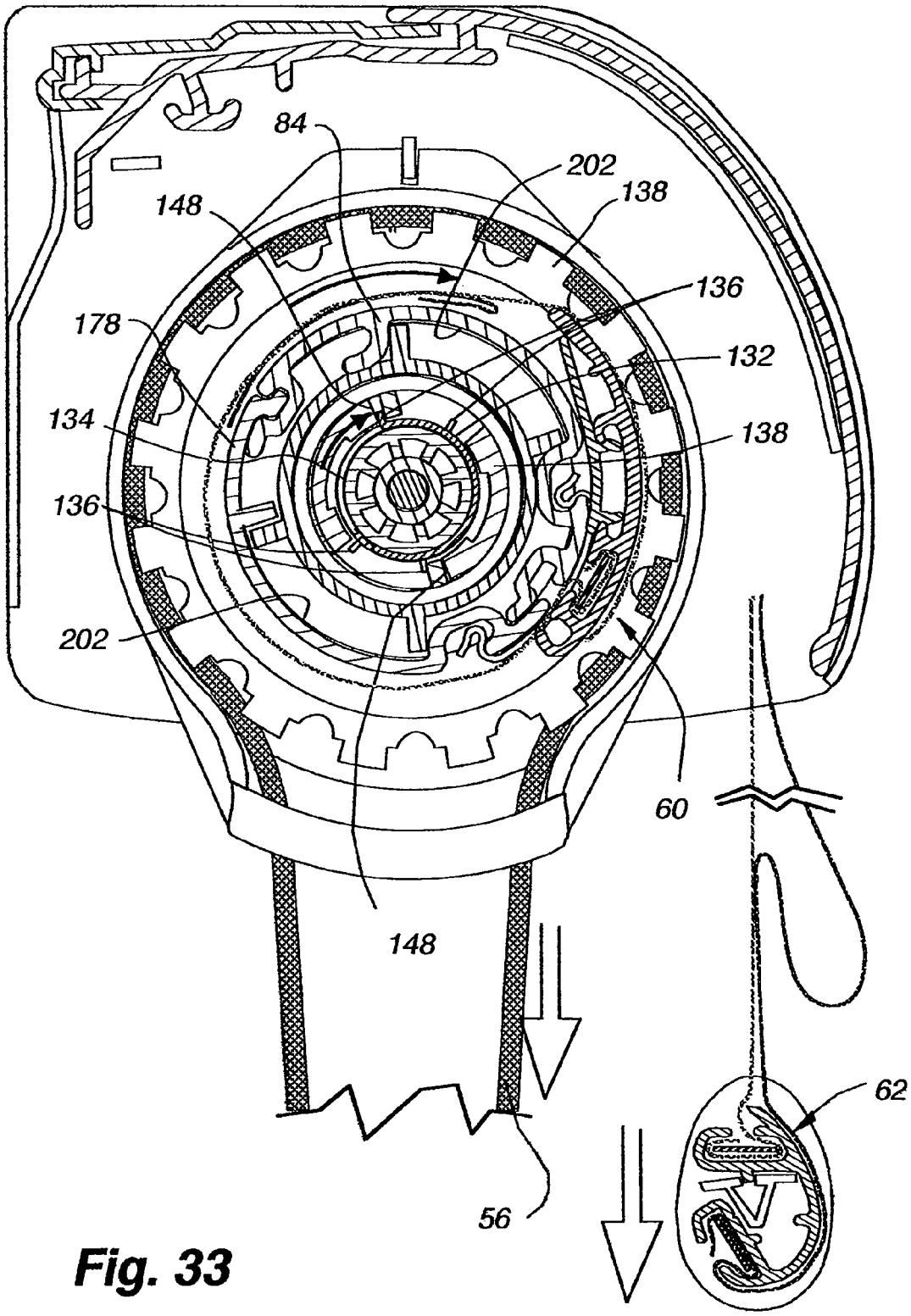
FIG. 33 is a section taken along line 33-33 of FIG. 29.
Figure 33A:
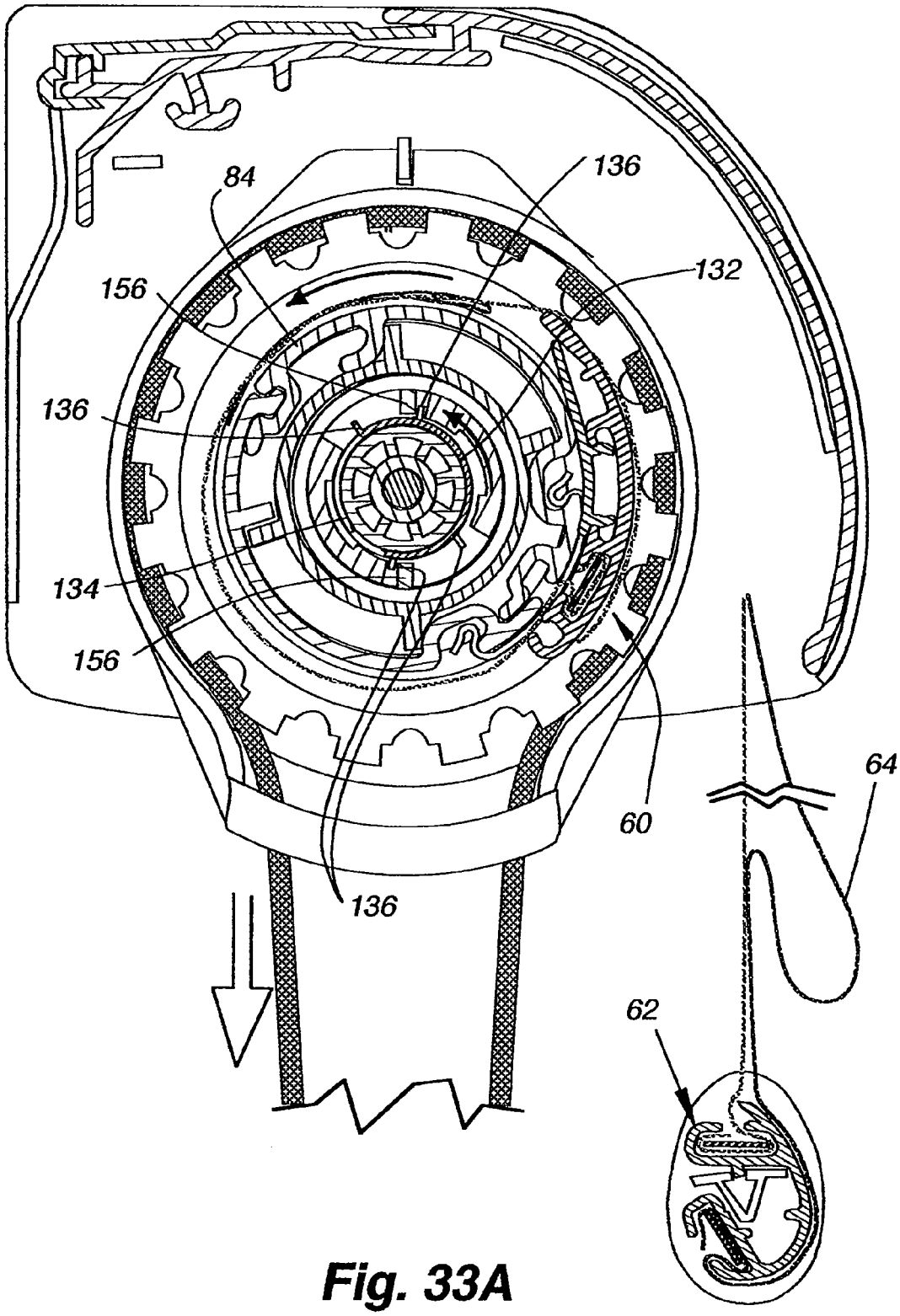
FIG. 33A is a section similar to FIG. 33 with the components in a slightly differently position.
Figure 34:
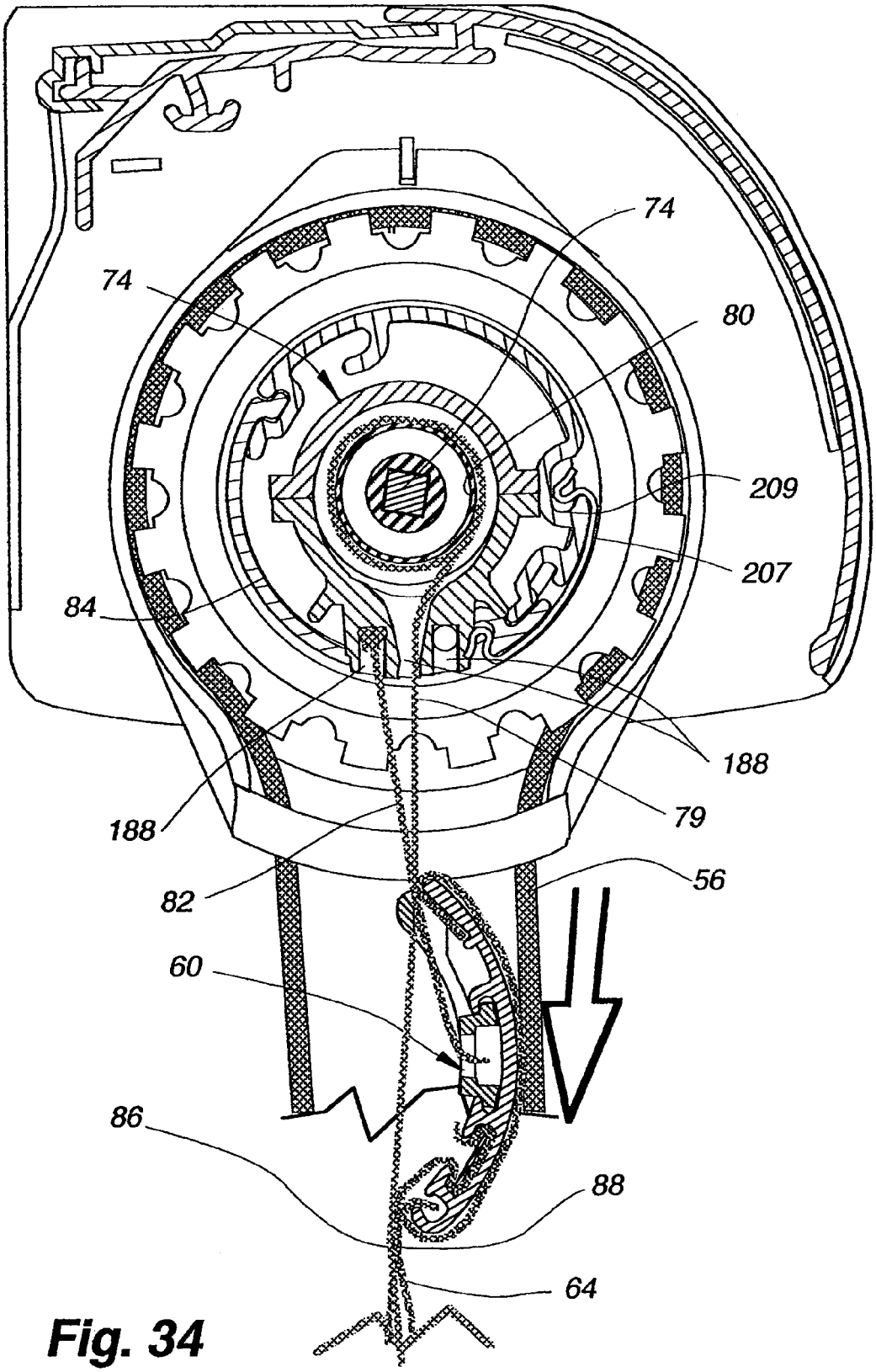
FIG. 34 is a section taken along line 34-34 of FIG. 30.
Figure 35:
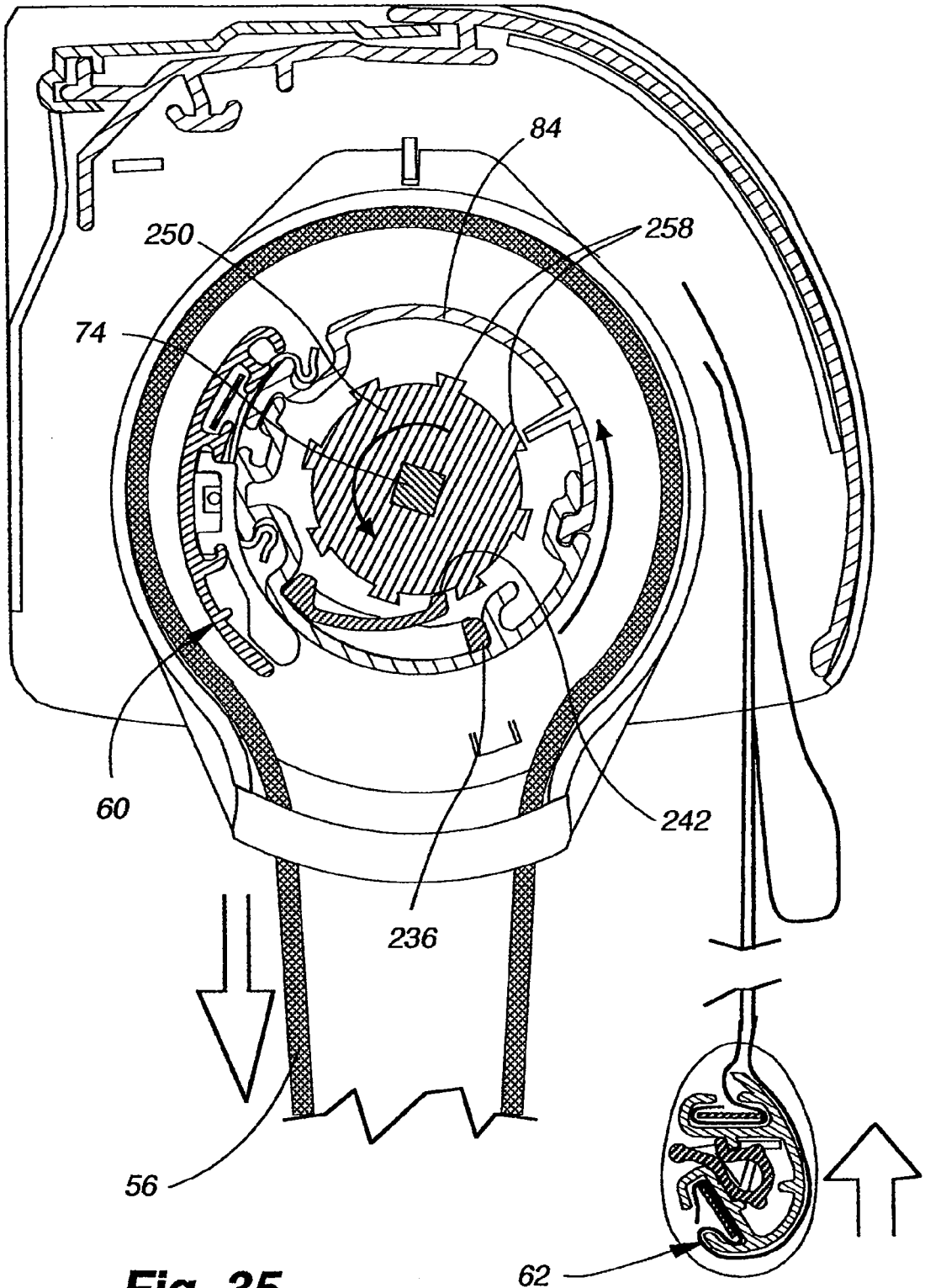
FIG. 35 is a section taken along line 35-35 of FIG. 32B.

It is to be noted that the initial lowering of the bottom rail 62 and the subsequent lowering of the middle rail 60 all occur during a clockwise rotation of the operating cord and thus, the drive wheel 138 as viewed in FIGS. 33-35. Once both rails are fully lowered, however, the cord can no longer be rotated in that direction as the square drive shaft 74 can no longer rotate relative to the roller 84 due to the lift spool followers' 198 engagement with the left abutment collar 208 and the spool follower's connection for unitary rotative movement with the roller 84, which is prevented from rotation by the stop tab 230 on limit screw 228.

It should be appreciated from the above, however, that the bottom rail 62 can be lowered to any desired degree from the fully retracted position of FIG. 1 simply by terminating rotation of the drive wheel 138 and the covering will be locked in position with the spring clutch 72 as the coil springs 132 will grab the support shaft 122. Accordingly, the flexible shade material 64 can be extended to any degree downwardly from the middle rail, which is adjacent the head rail 58. Of course, continued rotation of the drive wheel in the clockwise direction as mentioned above, causes the middle rail to subsequently descend itself so the covering is operated in a top down manner and the flexible shade material 64 extends from the bottom rail, which is then adjacent to the bottom sill, upwardly to the middle rail which can be terminated at any location.

Figure 31:
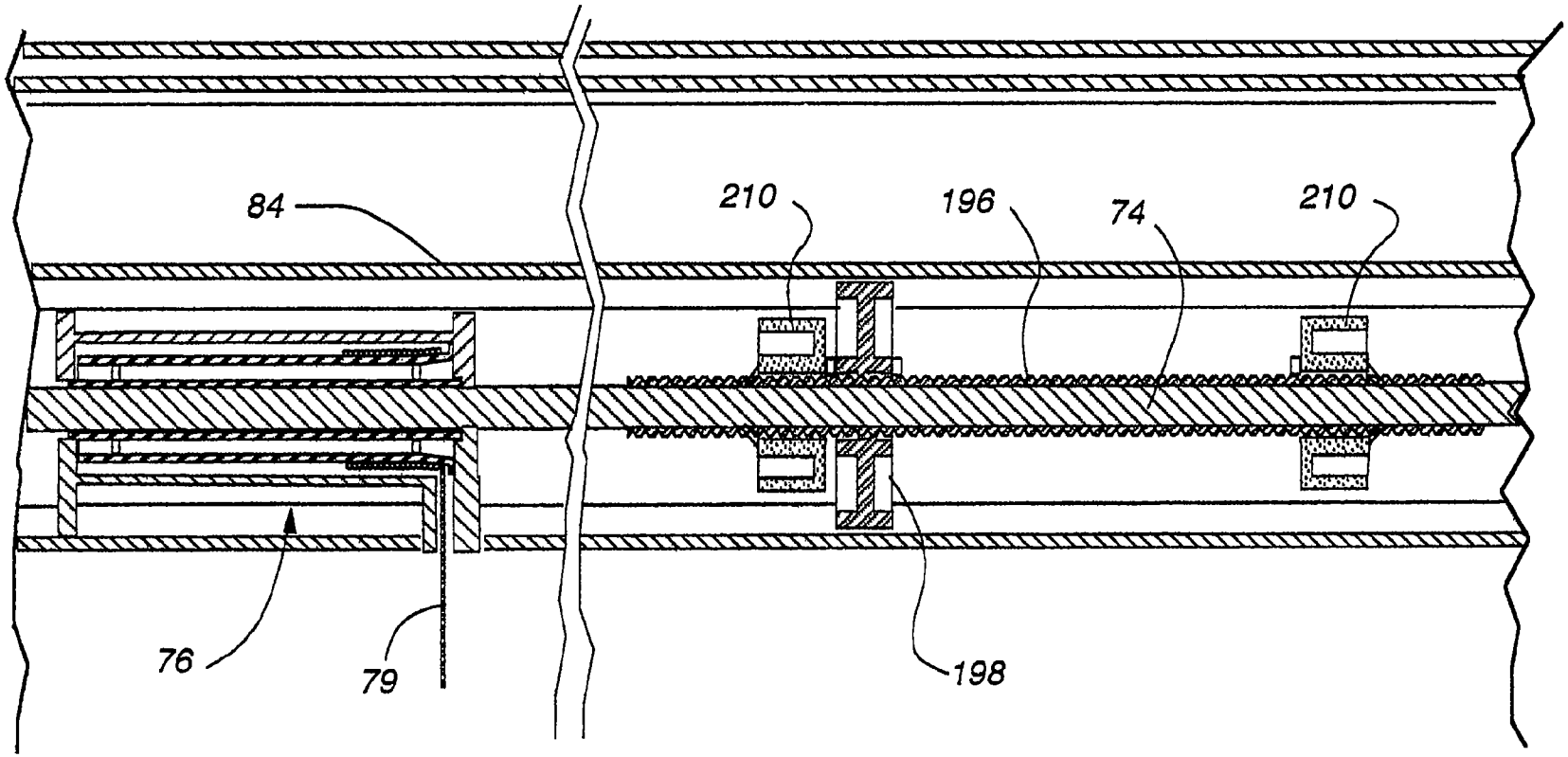
FIG. 31 is an enlarged section taken along line 31-31 of FIG. 5.
Figure 31A:
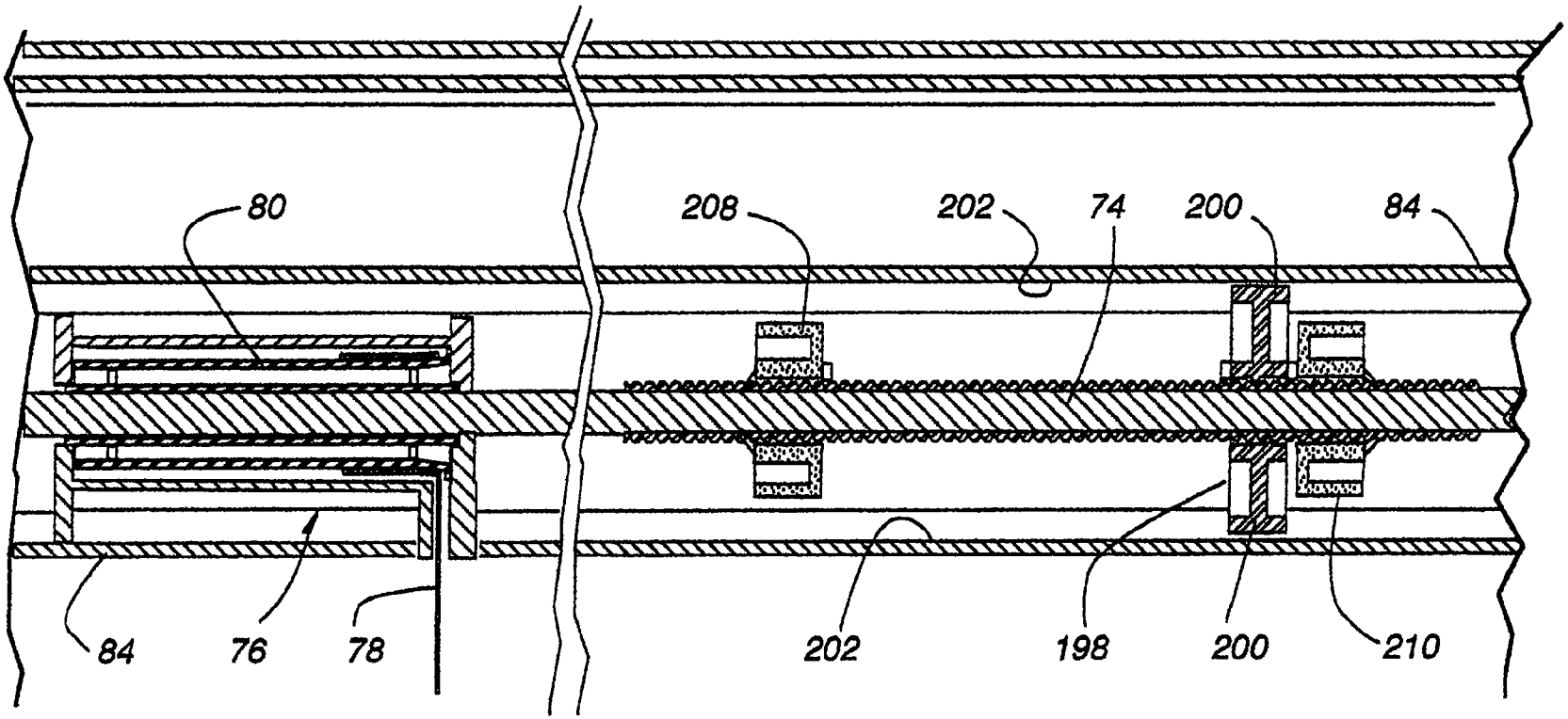
FIG. 31A is a section similar to FIG. 31 showing the followers in an opposite position.
Figure 32:
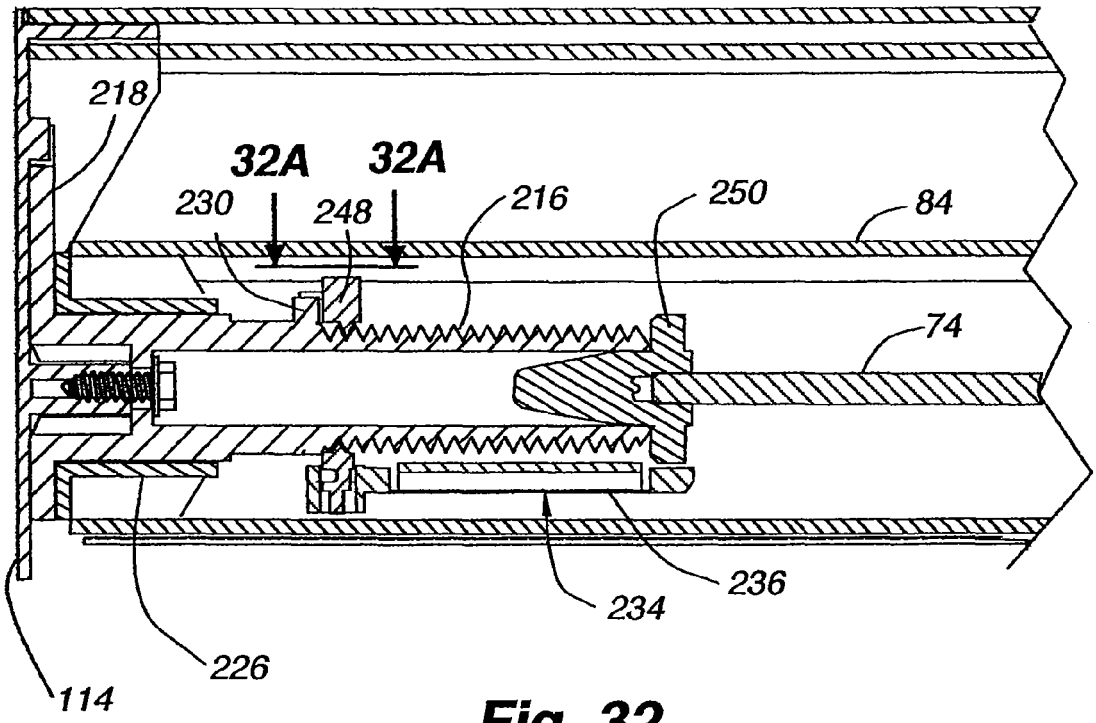
FIG. 32 is an enlarged section taken along line 32-32 of FIG. 5.
Figure 32A:
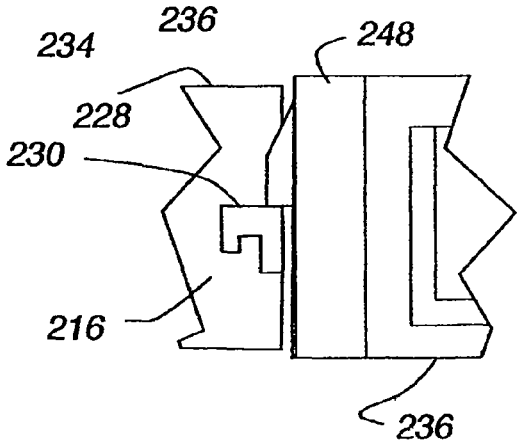
FIG. 32A is an enlarged section taken along line 32A-32A of FIG. 32.
Figure 32B:
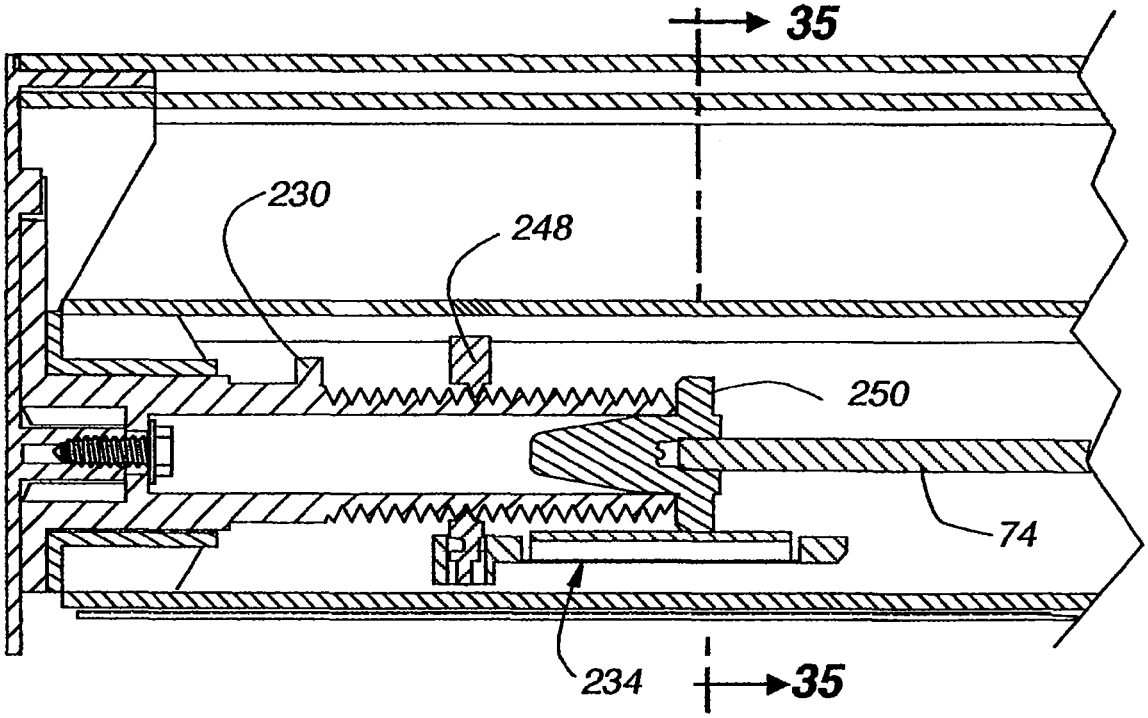
FIG. 32B is a section similar to FIG. 32 showing the followers in a different position.

When the middle 60 and bottom 62 rails are fully extended as shown in FIG. 3, and the control cord is moved in a counter-clockwise direction, so as to drive the drive wheel 138 in a counter-clockwise direction and also the square drive shaft 74 which follows the drive wheel, the lift spool follower 198 which is tied to the roller 84 and therefore held stationary partly due to the weight of the fabric will begin to translate to the right toward the position of FIG. 31A as the square threaded shaft 196 on which it is mounted is rotating while the spool follower itself remains non-rotating. Of course, as the square drive shaft 74 rotates, so do the lift spools 80 and as mentioned previously, if the roller 84 is not rotating, the lift spools will cause the lift cords to be wound therearound thereby elevating the middle rail and lifting the top edge of the flexible sheet material 64. When the lift spool follower engages the right abutment collar 210 as in FIG. 31A, the middle rail will have fully retracted into a position adjacent to the head rail 58 so the flexible sheet material is again fully extended across the architectural opening with the bottom rail at its fully extended or lowermost position and the middle rail at its fully retracted or uppermost position. Continued rotation of the drive wheel in the counter-clockwise direction will then force the roller 84 to begin rotating as the spool follower is then engaged with the right abutment collar 210 and the tabs 200 on the lift spool follower force the roller to rotate with the lift spool follower. The roller thereafter rotates with the drive shaft 74. Of course as the lift spool follower begins to rotate with the roller, the flexible sheet material along with the roller lift cords 82 associated with the bottom rail are wrapped about the roller until the abutment tabs 302 at opposite ends of the bottom rail engage the head rail 58 to terminate further upward movement of the bottom rail, thus placing the covering in the fully retracted position of FIG. 1.

As the roller is rotating in the counter-clockwise direction, the two-piece follower 234, which moves with the roller 84 and relative to the threaded shaft 216, translates to the right but as is appreciated, the cogwheel 250 is also rotating but in a direction such that as it begins to engage the lip 242 on the flex finger 238, which is translating linearly therebeneath, the flex finger merely flexes downwardly and allows the cogwheel to pass or snap thereby.

Again it will be appreciated in this direction of movement of the drive wheel 138, either the middle rail 60 or the bottom rail 62 can be stopped at any desired position so the flexible shade material 64 can extend downwardly from the head rail to any desired degree or upwardly from the bottom sill to any desired degree.

It should be pointed out that the abutment collar 210 could be removed and the system would still work even though stress would be added to the spool lift cords 79. In other words, if the abutment collar 210 was not used and the middle rail 60 was raised until it was adjacent to the roller 84, continued movement of the control element, instead of causing the lift spool follower 198 to engage the abutment collar 210, would simply permit the spool lift cords to try to further lift the middle rail causing the middle rail to force the roller to rotate thereby lifting the bottom rail.

Although the present invention has been described with a certain degree of particularity, it is understood the disclosure has been made by way of example, and changes in detail or structure may be made without departing from the spirit of the invention as defined in the appended claims.

The invention claimed is:

1. A shade material for coverings for architectural openings comprising in combination:

a first sheet of shade material having a length and a width, a second sheet of material having a greater length than said first sheet of material and substantially the same width as said first sheet of material, a plurality of parallel continuous lines of hot-melt adhesive extending across the width of one of said first and second sheets of material, said first and second sheets being adhesively secured together at intervals along said continuous lines of adhesive which are activated in said intervals but not in gaps existing between said intervals such that loops of material are formed in said second sheet between said lines of adhesive and said gaps exist along said lines of adhesive between said intervals where the sheets are not secured.

2. The shade material of claim 1 wherein said adhesive is non-tacky until heated above a predetermined temperature.

3. The shade material of claim 2 wherein said sheets of material are secured together by heating said lines of adhesive above said predetermined temperature in said intervals and engaging said materials along said lines of adhesive.

4. The shade material of claim 3 wherein said lines of adhesive are ultrasonically heated by placing said sheets with the lines of adhesive on one of said sheets on an anvil and advancing an ultrasonic horn against the sheets of material in a manner to heat said lines of adhesive only along said intervals.

5. The shade material of claim 4 wherein said horn has a substantially flat face for engagement with said sheets and wherein said anvil includes channels which are aligned with said gaps so that said lines of adhesive are not heated above said predetermined temperature where said lines of adhesive are aligned with said channels.

* * * * *